US006270392B1

(12) United States Patent
Hayashi et al.

(10) Patent No.: US 6,270,392 B1
(45) Date of Patent: Aug. 7, 2001

(54) POLISHING APPARATUS AND METHOD WITH CONSTANT POLISHING PRESSURE

(75) Inventors: Yoshihiro Hayashi; Takahiro Onodera, both of Tokyo; Yamato Samitsu, Kanagawa; Kiyoshi Tanaka, Kanagawa; Naoki Sasaki, Kanagawa, all of (JP)

(73) Assignees: NEC Corporation; Niken Corporation, both of Tokyo (JP)

( * ) Notice: Subject to any disclaimer, the term of this patent is extended or adjusted under 35 U.S.C. 154(b) by 0 days.

(21) Appl. No.: 09/335,985

(22) Filed: Jun. 18, 1999

(30) Foreign Application Priority Data

Jun. 19, 1998 (JP) ..... 10-173715

(51) Int. Cl.[7] ..... B24B 1/00

(52) U.S. Cl. ..... 451/5; 451/41; 451/9; 451/10; 451/60; 451/285; 451/287

(58) Field of Search ..... 451/5, 41, 285–289, 451/291, 10, 60, 9–11; 438/692, 693

(56) References Cited

U.S. PATENT DOCUMENTS 5,486,129 1/1996 Sandhu et al. .
5,567,199 * 10/1996 Huber et al. ..... 451/398
5,816,895 * 10/1998 Honda ..... 451/41
6,004,187 * 12/1999 Nyui et al. ..... 451/5
6,106,369 * 8/2000 Konishi et al. ..... 451/41
6,159,080 * 12/2000 Talieh ..... 451/41
6,162,112 * 12/2000 Miyazaki et al. ..... 451/36

FOREIGN PATENT DOCUMENTS 57-168861 10/1982 (JP) .
63-256356 10/1988 (JP) .
1-193172 8/1989 (JP) .
5-160088 6/1993 (JP) .
5-285825 11/1993 (JP) .
6-338484 12/1994 (JP) .
7-88759 4/1995 (JP) .
8-11044 1/1996 (JP) .
10-296617 11/1998 (JP) .

* cited by examiner

*Primary Examiner*—Joseph J. Hail, III
*Assistant Examiner*—George Nguyen
(74) *Attorney, Agent, or Firm*—Scully, Scott, Murphy & Presser

(57) ABSTRACT

In an apparatus for polishing a substrate, including a polishing platen for mounting the substrate thereon, a polishing head, a polishing pad adhered to a bottom face of the polishing head, and a rocking section for rocking. I.e., moving the polishing head in the horizontal direction with respect to the polishing platen, a control circuit controls a load of the polishing pad applied to the substrate in accordance with a contact area of the polishing pad to the substrate.

21 Claims, 17 Drawing Sheets

POLISHING APPARATUS AND METHOD WITH CONSTANT POLISHING PRESSURE

BACKGROUND OF THE INVENTION

1. Field of the Invention

The present invention relates to a polishing apparatus and method for polishing a substrate in a process of planarizing the surface of a semiconductor wafer where a semiconductor device pattern is formed. Such a polishing apparatus is called a chemical mechanical polishing (CMP) apparatus.

2. Description of the Related Art

In a first prior art CMP apparatus (see JP-A-63-256356), a polishing platen associated with a polishing cloth (pad) thereon is rotated in one direction, and a polishing head is rotated in the same direction as that of the polishing platen.

Also, the back face of a semiconductor wafer is chucked to the bottom face of the polishing head. Therefore, the rotating polishing head with the semiconductor wafer is pushed onto the rotating polishing cloth while the rotating polishing head is rocking moving forward and backward in the horizontal direction. Thus, the front face of the semiconductor wafer can be flattened (paganized). This will be explained later in detail.

In the above-described first prior art CMP apparatus, however, since the polishing face of the semiconductor wafer is pushed onto the polishing cloth, it is impossible to observe the polishing face of the semiconductor wafer, so that an accurate control of thickness of the surface layer of the semiconductor wafer cannot be expected. Also, since the diameter of the polishing cloth is twice or more than that of the semiconductor wafer, most of the polishing liquid (abrasive) is dispersed by the centrifugal force due to the rotation of the polishing platen without contributing to the polishing of the semiconductor wafer, the utilization efficiency of the polishing liquid is low.

In a second prior art CMP apparatus (see JP-A-5-160088), a polishing platen for mounting a semiconductor wafer is rotated in one direction, and a polishing head associated with a polishing cloth thereon is rotated in the same direction as that of the polishing platen. In this case, the back face of the semiconductor wafer is chucked to the face of the polishing platen. Also, the diameter of the polishing cloth is much smaller than that of the semiconductor wafer. Further, the polishing platen and the polishing cloth are rotated in the same direction. This also will be explained later in detail.

In the above-described second prior art CMP apparatus, however, since the diameter of the polishing cloth is much smaller that of the semiconductor wafer, the contact area of the polishing cloth to the semiconductor wafer W is very small, so that the polishing efficiency is very small.

Also, when the polishing cloth deviates from the edge of the semiconductor wafer, the contact area of the polishing cloth to the semiconductor wafer becomes small. As a result, the polishing speed in the edge of the semiconductor wafer increases.

Further, since the rotational direction of the polishing platen, i.e., the semiconductor wafer is the same as that of the polishing head, most of polishing liquid is dispersed by the centrifugal force due to the polishing platen in addition to the centrifugal force due to the polishing head without contributing to the polishing of the semiconductor wafer, so that the utilization efficiency of the polishing liquid is low.

Additionally, since the polishing cloth is circular, the polishing power of the polishing cloth at its periphery is substantially increased.

Therefore, the polishing power is small at the center of the polishing cloth, while the polishing power is large at its periphery. Thus, it is difficult to homogenize the polishing power over the semiconductor wafer in spite of the rocking operation.

A third prior art CMP apparatus (see JP-A-7-88759), which also will be explained later in detail, also has the same problems as in the second prior art CMP apparatus.

SUMMARY OF THE INVENTION

It is an object of the present invention to provide a polishing apparatus and method having a large polishing efficiency, a suppressed polishing speed around the periphery of a semiconductor wafer (substrate), and high utilization of polishing liquid.

According to the present invention, in an apparatus for polishing a substrate, including a polishing platen for mounting the substrate thereon, a polishing head, a polishing pad adhered to a bottom face of the polishing head, and a rocking section, for rocking (moving) the polishing head in the horizontal direction with respect to the polishing platen, a control circuit controls a load of the polishing pad applied to the substrate in accordance with a contact area of the polishing pad to the substrate. Thus, the polishing pressure can be constant over the substrate.

Also, in a polishing method, a contact area of the polishing pad to the substrate is calculated. Then, a load of the polishing pad is calculated by multiplying the contact area of the polishing pad to the substrate by a contact polishing pressure. Finally, a load of the polishing pad is controlled in accordance with the calculated load of the polishing pad.

BRIEF DESCRIPTION OF THE DRAWINGS

The present invention will be more clearly understood from the description set forth below, as compared with the prior art, with reference to the accompanying drawings, wherein.

DESCRIPTION OF THE PREFERRED EMBODIMENT

Before the description of the preferred embodiment, prior art CMP apparatuses will be explained with reference to FIGS. 1, 2 and 3.

Figure 1:
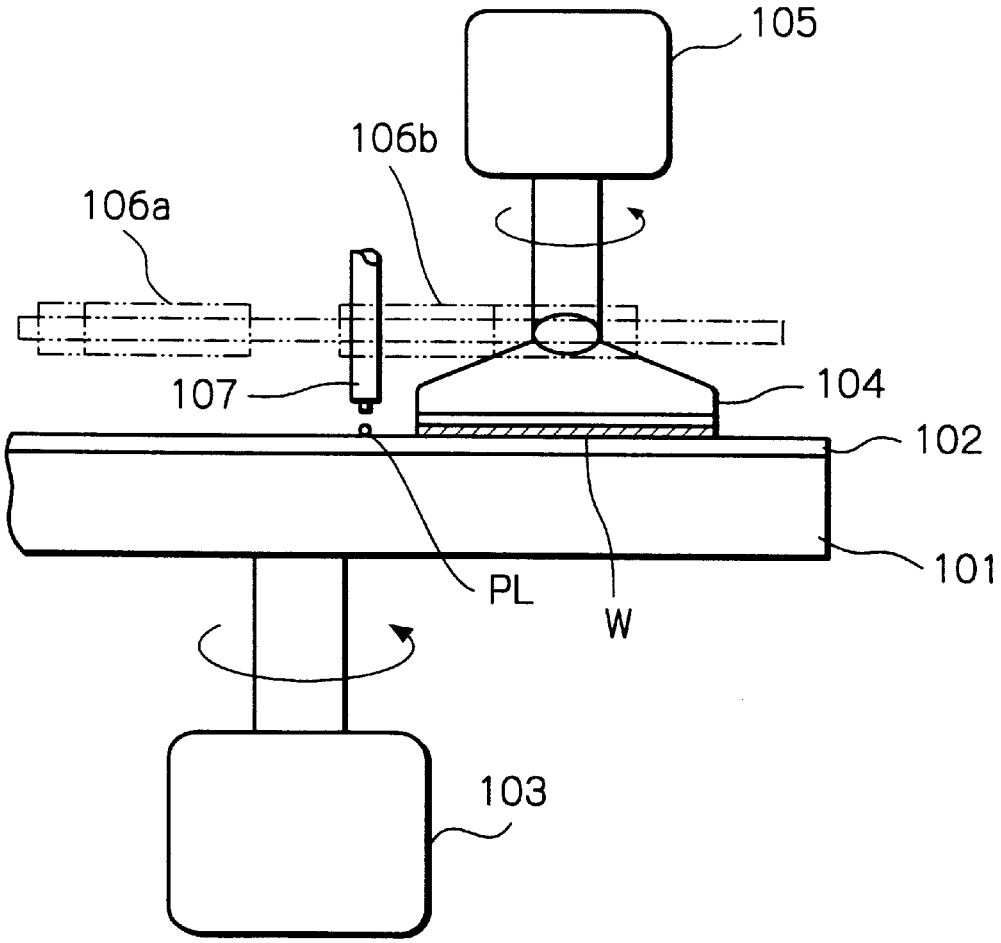
Fig. 1 PRIOR ART
FIG. 1 is a side view illustrating a first prior art CMP apparatus.

In FIG. 1, which is a side view illustrating a first CMP apparatus (see JP-A-63-256356), a polishing platen 101 associated with a polishing cloth (pad) 102 thereon is rotated in one direction by a motor 103, and a polishing head 104 is rotated in the same direction as that of the polishing platen 101 by a motor 105. In this case, the rotational speed of the polishing platen 101 is about the same as that of the polishing head 104.

Also, the back face of a semiconductor wafer W is chucked to the bottom face of the polishing head 104. Therefore, when the rotating polishing head 104 is pushed onto the rotating polishing cloth 102 while the rotating polishing head 104 is rocking (moving)) in the horizontal direction by a stationary cylinder 106*a* and a rocking cylinder 106*b* in combination, the front face of the semiconductor wafer W can be flattened.

Further, a polishing liquid supplying nozzle 107 is provided above the center of the polishing platen 102. As a result, onto the polishing cloth 102 is dripped polishing liquid PL from the polishing liquid supplying nozzle 107, so that the polishing liquid PL is dispersed from the center of the polishing cloth 102 to the periphery thereof by the centrifugal force due to the rotation of the polishing platen 101.

In the CMP apparatus of FIG. 1, however, since the polishing face of the semiconductor wafer W is pushed onto the polishing cloth 102, it is impossible to observe the polishing face of the semiconductor wafer W, so that an accurate control of thickness of the surface layer of the semiconductor wafer W cannot be expected. Also, since the diameter of the polishing cloth 102 is twice or more than that of the semiconductor wafer w, most of the polishing liquid PL is dispersed by the centrifugal force due to the rotation of the polishing platen 101 without contributing to the polishing of the semiconductor wafer W, the utilization efficiency of the polishing liquid PL is low.

Figure 2:
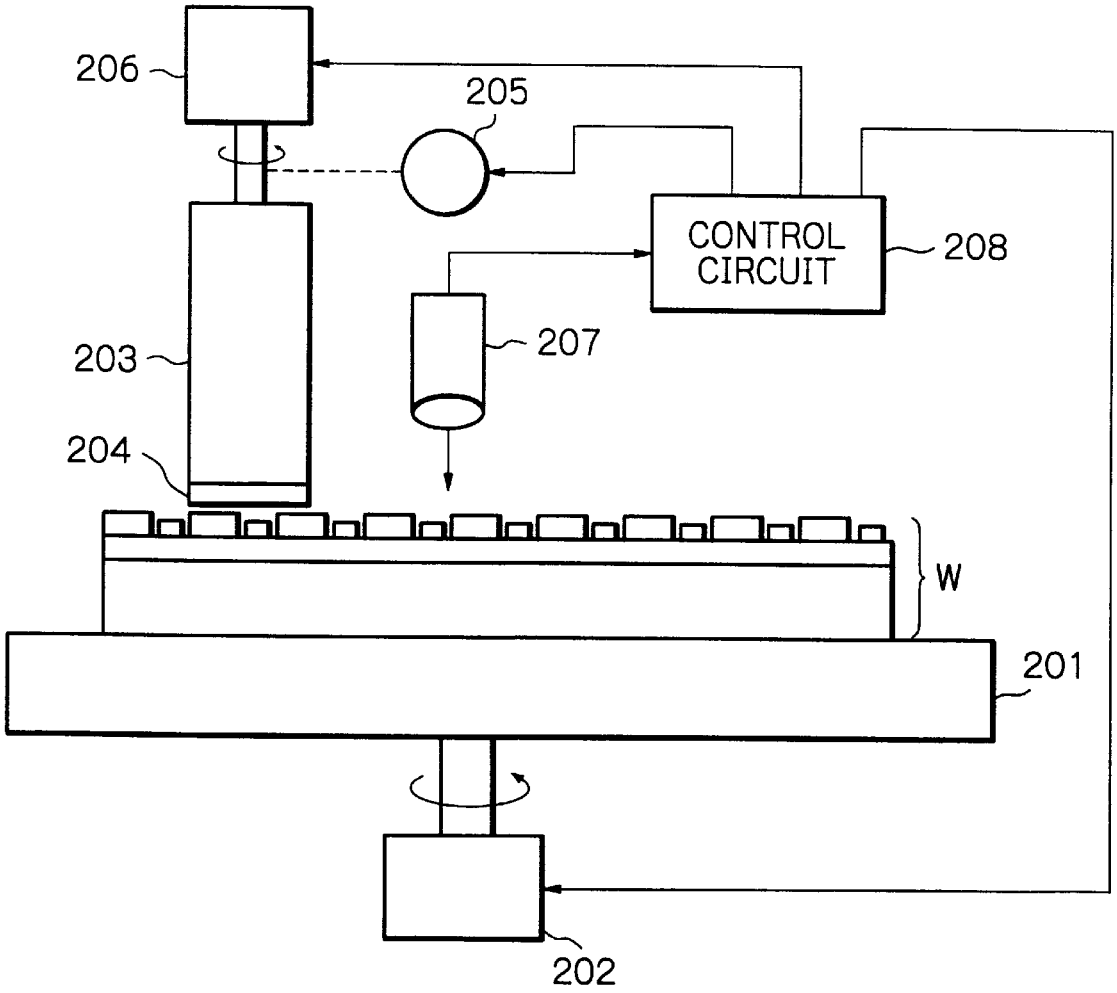
Fig. 2 PRIOR ART
FIG. 2 is a side view illustrating a second prior art CMP apparatus.

In FIG. 2, which is a side view illustrating a second CMP apparatus (see JP-A-5-160088), a polishing platen 201 for mounting a semiconductor wafer W is rotated in one direction by a motor 202, and a polishing head associated with a polishing cloth 204 thereon is rotated in the same direction as that of the polishing platen 201 by a motor 205. In this case, the back face of the semiconductor wafer W is chucked to the face of the polishing platen 201. Also, the diameter of the polishing cloth 204 is much smaller than that of the semiconductor wafer W.

Also, a pushing mechanism 206 is provided to push the polishing cloth 204 onto the semiconductor wafer W, and a detector 207 is provided to detect the thickness of a layer such as an insulating layer of the semiconductor wafer W.

Further, a control circuit 208 receives an output signal of the detector 207 to control the motors 202 and 205 and the pushing mechanism 206.

In the CMP apparatus of FIG. 2, the polishing platen 201 is rotated at a speed of about 0 to several rpm and the polishing cloth 204 is rotated at a speed of about 60 to 200 rpm. Also, the control circuit 208 controls the pushing mechanism 206 in accordance with the thickness of the layer of the semiconductor wafer W detected by the detector 207. Thus, the polishing head 203 is rocking in the horizontal direction. The thickness of the layer becomes homogeneous over the semiconductor wafer W.

In the CMP apparatus of FIG. 2, however, since the diameter of the polishing cloth 204 is much smaller than that of the semiconductor wafer W, the contact area of the polishing cloth 203 to the semiconductor wafer W is very small, so that the polishing efficiency is very small.

Also, when the polishing cloth 204 deviates from the edge of the semiconductor wafer W, the contact area of the polishing cloth 204 to the semiconductor wafer W becomes small. In this case, if the load L of the polishing head 203 is definite, the effective polishing pressure P increases. Note that the effective polishing pressure P can be represented by $$P=L/S$$

where S is the contact area of the polishing cloth 204 to the semiconductor wafer W. As a result, the polishing speed increases. Particularly, if the diameter of the polishing cloth 204 is very small, the polishing speed remarkably increases, which is a serious problem.

Further, since the rotational direction of the polishing platen 201, i.e., the semiconductor wafer W is the same as that of the polishing head 203, most of the polishing liquid is dispersed by the centrifugal force due to the polishing platen 201 in addition to the centrifugal force due to the polishing head 203 without contributing to the polishing of the semiconductor wafer W, so that the utilization efficiency of the polishing liquid is low.

Additionally, since the polishing cloth 204 is circular, the polishing power PP of the polishing cloth 204 at its periphery is substantially increased. That is, the circumferential speed V of the polishing cloth 204 is represented by $$V=R\cdot\omega \quad (1)$$

where R is a radius of the polishing cloth 204; and

ω is an angular speed of the polishing cloth 204.

Also, the circumference length CL of the polishing cloth 204 is represented by $$CL=2\pi R \quad (2)$$

On the other hand, if the polishing load is definite, the polishing power PP is represented by $$PP=V\cdot L \quad (3)$$

From the equations (1), (2) and (3), $$PP=2\pi R^2\cdot\omega$$

Therefore, the polishing power PP is small at the center of the polishing cloth 204, while the polishing power PP is large at its periphery. Thus, if the rotational speed of the clothing cloth 204 is increased to increase the polishing efficiency, it is difficult to homogenize the polishing power PP over the semiconductor wafer W in spite of the rocking operation.

Figure 3:
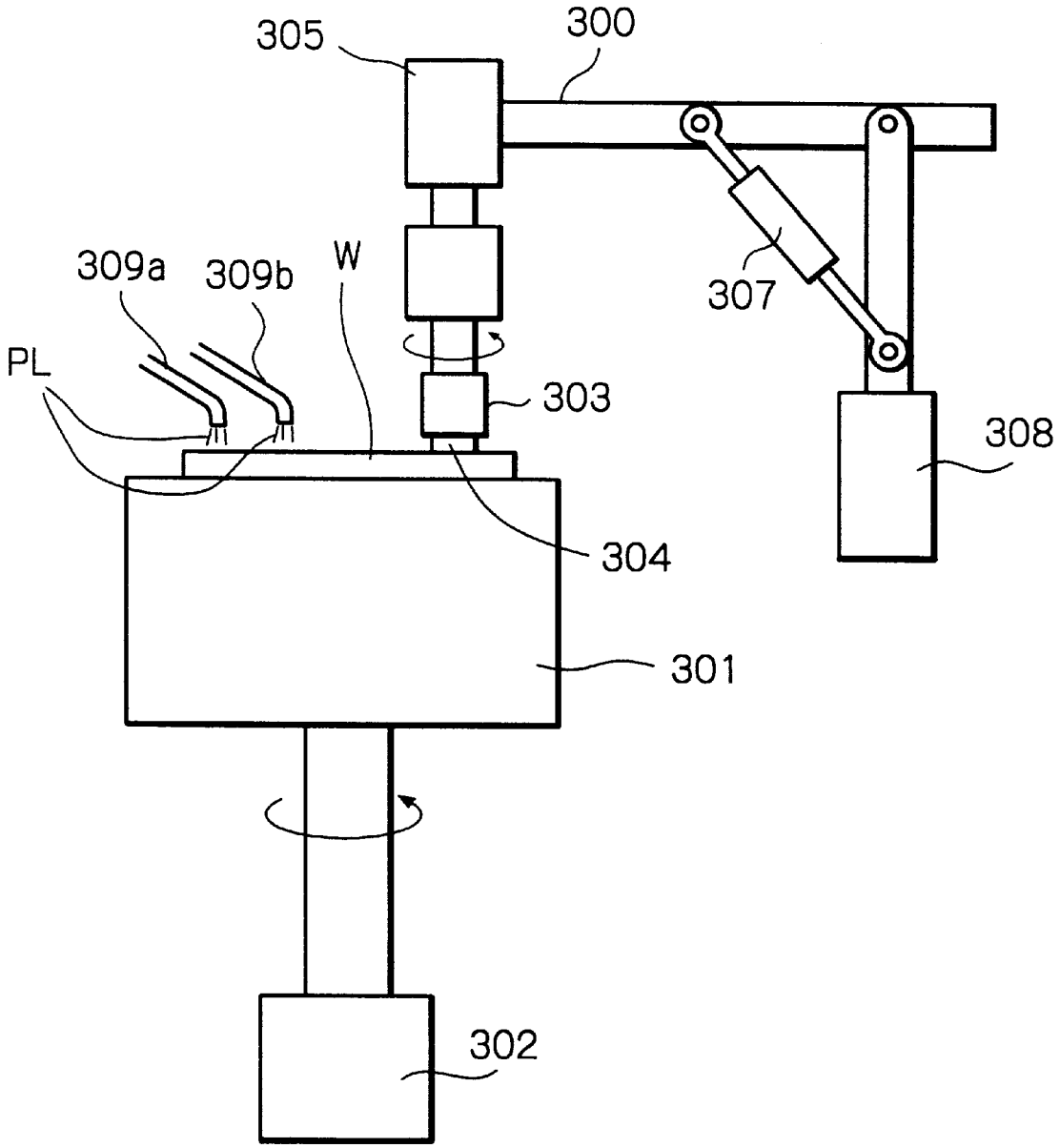
Fig. 3 PRIOR ART
FIG. 3 is a side view illustrating a third prior art CMP apparatus.

In FIG. 3, which is a side view illustrating a third prior art CMP apparatus (see JP-A-7-88759), a polishing platen 301 for mounting a semiconductor wafer W is rotated in one direction by a motor 302, and a polishing head associated with a polishing cloth 304 thereon is rotated in the same direction as that of the polishing platen 301 by a motor 305. In this case, the back face of the semiconductor wafer W is chucked to the face of the polishing platen 301. Also, the diameter of the polishing cloth 304 is much smaller than that of the semiconductor wafer W.

Also, an arm 306 and an air cylinder 307 as a pushing mechanism are provided to push the polishing cloth 304 onto the semiconductor wafer W.

Further, the polishing head 303 is rocking in the horizontal direction by a motor 308.

Additionally, polishing liquid supplying nozzles 309*a* and 309*b* are provided above the polishing platen 301. As a result, onto the semiconductor wafer W is dripped polishing liquid PL from the polishing liquid supplying nozzles 309*a* and 309*b*.

In the CMP apparatus of FIG. 3, the polishing platen 301 is rotated at a speed of about 50 rpm and the polishing cloth 304 is rotated at a speed of about 1000 rpm. Also, the load L of the polishing head 304 is set at about 0.01 to 0.5 kg/cm$^2$ by the air cylinder 305.

If the polishing head 303 is rocking in the horizontal direction at about 10 to 100 times per minute by the motor 308, the thickness of the layer becomes homogeneous over the semiconductor wafer W.

In the CMP apparatus of FIG. 3, however, since the diameter of the polishing cloth 303 is much smaller that of the semiconductor wafer W, the contact area of the polishing cloth 303 to the semiconductor wafer W is very small, so that the polishing efficiency is very small.

Also, when the polishing cloth 304 deviates from the edge of the semiconductor wafer W, the contact area of the polishing cloth 304 to the semiconductor wafer W becomes small. In this case, if the load L of the polishing head 303 is definite, the effective polishing pressure P increases. As a result, the polishing speed increases. Particularly, if the diameter of the polishing cloth 304 is very small, the polishing speed remarkably increases, which is a serious problem.

Further, since the rotational direction of the polishing platen 301, i.e., the semiconductor wafer W is the same as that of the polishing head 303, most of the polishing liquid is dispersed by the centrifugal force due to the polishing platen 301 in addition to the centrifugal force due to the polishing head 303 without contributing to the polishing of the semiconductor wafer W, so that the utilization efficiency of the polishing liquid is low.

Additionally, in the same way as in the CMP apparatus of FIG. 2, since the polishing cloth 204 is circular, if the rotational speed of the clothing cloth 304 is increased to increase the polishing efficiency, it is difficult to homogenize the polishing power PP over the semiconductor wafer W in spite of the rocking operation.

Figure 4:
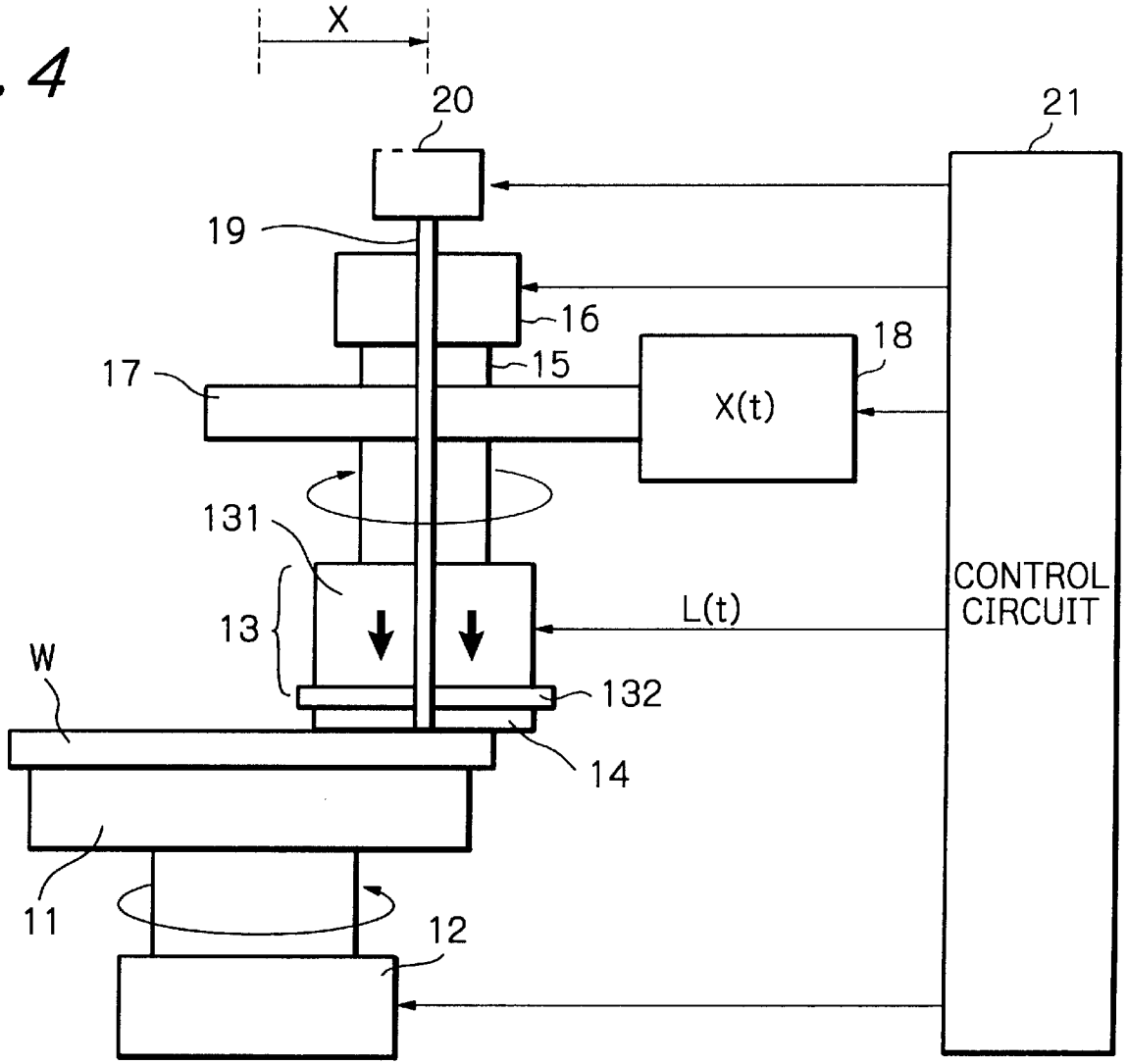
FIG. 4 is a side view illustrating an embodiment of the CMP apparatus according to the present invention.

In FIG. 4, which illustrates an embodiment of the CMP apparatus according to the present invention, a polishing platen 11 for mounting a semiconductor wafer W is rotated in a first direction such as in a counter-clockwise direction by a motor 12, and a polishing head 13 associated with a polishing cloth 14 thereon is rotated in a second direction such as in a clockwise direction opposite to the first direction by a carrier 15 coupled to a motor 16. In this case, the back face of semiconductor wafer W is chucked to the face of the polishing platen 11. Also, the polishing cloth 14 is circular or non-circular; however, its substantial diameter is about half of the diameter of the semiconductor wafer W.

The polishing head 13 is constructed by a pressurizing chamber 131 and a plate 132 for adhering the polishing cloth 14, to thereby push the polishing cloth 14 on to the semiconductor wafer W. In this case, the pressure of the pressurizing chamber 131 is controlled by an air cylinder (not shown) to change the load L(t) of the polishing cloth 14 applied to the semiconductor wafer W.

The polishing head 13 is rocking in the horizontal direction by a rocking guide rail 17 which is driven by a rocking driving section (motor) 18.

A pipe 19 is provided in the center of the polishing head 13, the carrier 15 and the motor 16 to supply polishing liquid from a pump 20 to the semiconductor wafer W under the polishing cloth 14.

The motor 12, the load L(x) of the pressurizing chamber 131, the rocking driving section 18, the motor 16 and the pump 20 are controlled by a control circuit 21 which is constructed by a computer, for example.

A first rocking operation of the CMP apparatus of FIG. 4 is explained next with reference to FIGS. 5A, 5B and 5C, where the polishing cloth 14 is circular and its diameter is approximately half of that of the semiconductor wafer W. That is, $$r\approx R/2$$

where r is a radius of the polishing cloth 14; and

R is a radius of the semiconductor wafer W.

Figure 5A:
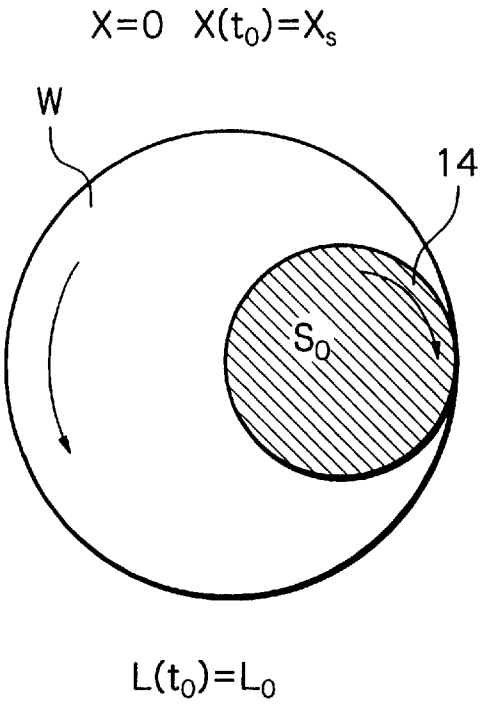
FIGS. 5A, 5B and 5C are diagrams for explaining a first rocking operation of the CMP apparatus of FIG. 4.

First, referring to FIG. 5A, at time $t_o$, the coordinate X of the center of polishing cloth 14 in the right direction with respect to the center of the semiconductor wafer W is set to be $$X(t_0)=X_s$$

where $X_s$ is a start rocking distance and is R/2, for example. In this case, the contact area S(t) of the polishing cloth 14 to the semiconductor wafer W is $$S(t_0)=\pi R^2$$

Therefore, if an initial load($t_0$) of the polishing head 13 is given by $L_0$, the polishing pressure P is represented by $$P=L_0/S_0$$

Figure 5B:
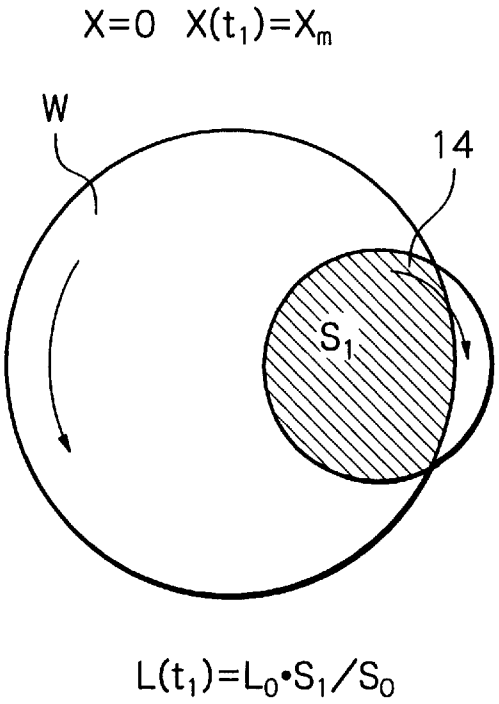

Next, referring to FIG. 5B, the coordinate X of the center of the polishing cloth 14 becomes $$X(t_1)=X_m>X_s$$

In this case, the contact area S(t) of the polishing cloth 14 to the semiconductor wafer W becomes smaller, i.e., $$S(t_1)=S_1<S_0$$

Therefore, the control circuit 21 reduces the load of the polishing head 13 to $$L(t_1) = L_0 \cdot S_1 / S_0$$
$$= P \cdot S_1$$

Figure 5C:
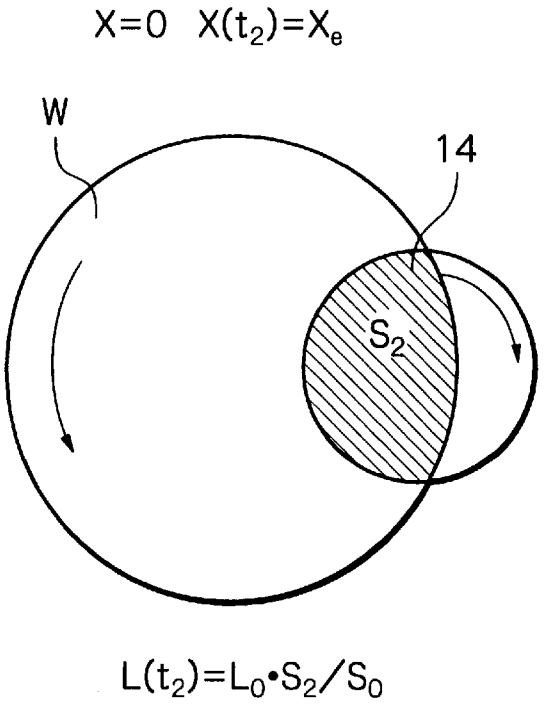

Finally, referring to FIG. 5C, the coordinate X of the center of the polishing cloth 14 becomes $$X(t_2)=X_e>X_m$$

where $X_e$ is 0.8R, for example. In this case, the contact area S(t) of the polishing cloth 14 to the semiconductor wafer W becomes even smaller, i.e., $$S(t_2)=S_2<S_1$$

Therefore, the control circuit 21 reduces the load of the polishing head 13 to $$L(t_2) = L_0 \cdot S_2 / S_0$$
$$= P \cdot S_2$$

Note that it is desirable that the cycle period from time $t_0$ to time $t_2$ of the rocking operation is larger than the cycle period of revolution of the semiconductor wafer W.

Thus, since the load L(t) of the polishing head 13 is changed in accordance with the contact area S(t) of the polishing cloth 14 to the semiconductor wafer W, the polishing pressure P can be definite.

Note that the control circuit 21 can store a relationship between the coordinate X(t) and the contact area $S(X_{(t)})$ as a table in a memory. In this case, the control circuit 21 detects the current coordinate X(t) of the polishing cloth 14, and then, calculates the contact area S(t) of the polishing cloth 14 to the semiconductor wafer W by using the above-mentioned table. Then, the control circuit 21 calculates the load L(t) by $$L(t)=P \cdot S(t)$$

where P is the definite polishing pressure.

Figure 6A:
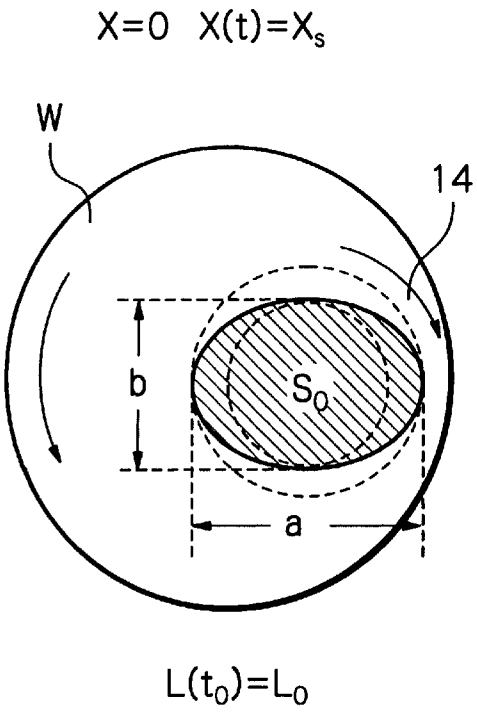
FIGS. 6A, 6B and 6C are diagrams for explaining a second rocking operation of the CMP apparatus of FIG. 4.
Figure 6B:
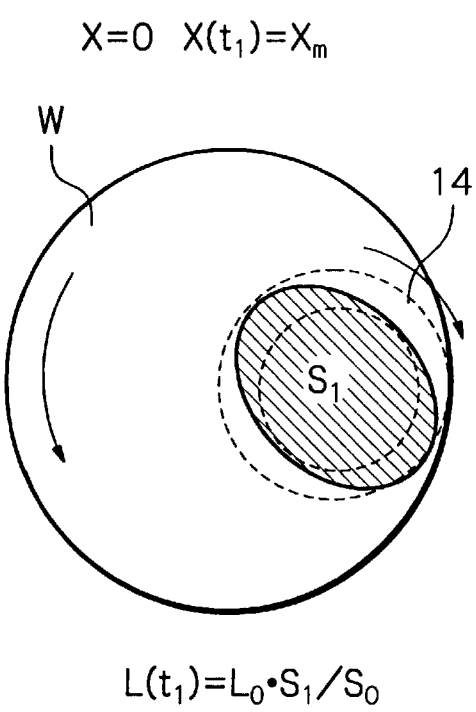
Figure 6C:
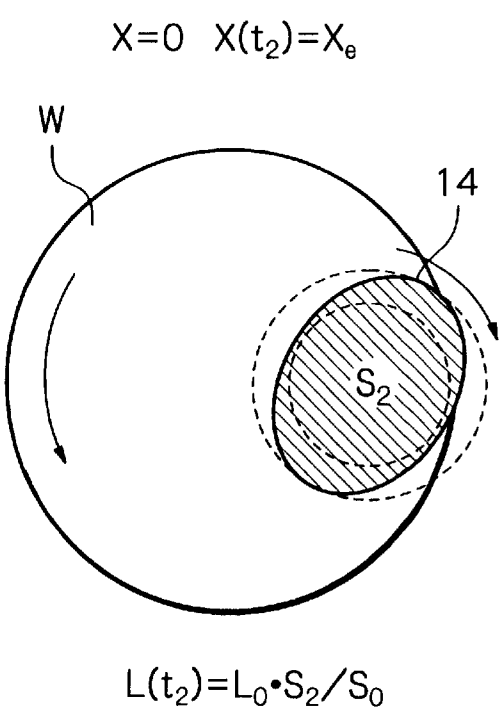

In FIGS. 5A, 5B and 5C, the polishing cloth 14 is circular, the polishing power PP is small at the center of the polishing cloth 14, while the polishing power PP is large its periphery. Thus, if the rotational speed of the clothing cloth 14 is increased to increase the polishing efficiency, it is difficult to homogenize the polishing power PP over the semiconductor wafer W in spite of the rocking operation. In order to homogenize the polish power PP over the semiconductor wafer W, the polishing cloth 14 is caused to be ellipsoidal as shown in FIGS. 6A, 6B and 6C.

A second rocking operation of the CMP apparatus of FIG. 4 is explained next with reference to FIGS. 6A, 6B and 6C, where the polishing cloth 14 is elliptic and its substantial diameter is approximately half of that of the semiconductor wafer W. That is, $$r \approx R/2$$

$$r=(a+b)/2$$

where "a" is a long diameter of the polishing cloth 14;

"b" is a short diameter of the polishing cloth 14; and

R is a radius of the semiconductor wafer W. Note that the short diameter "b" is preferably smaller than R; however, there is no limitation on the long diameter "a".

First, referring to FIG. 6A, at time $t_0$, the coordinate X of the center of polishing cloth 14 in the right direction with respect to the center of the semiconductor wafer W is set to be $$X(t_0)=X_s$$

where $X_s$ is a start rocking distance and is smaller than R/2 and larger than b/2. Thus, the inner circle of the polishing cloth 14 does not get to the center of the semiconductor wafer W. In this case, the contact area S(t) of the polishing cloth 14 to the semiconductor wafer W is $$S(t_0)=\pi r^2$$

Therefore, if an initial load $L(t_0)$ of the polishing head 13 is given by $L_0$, the polishing pressure P is represented by $$P=L_0/S_0$$

Next, referring to FIG. 6B, the coordinate X of the center of the polishing cloth 14 becomes $$X(t_1)=X_m>X_s$$

In this case, the contact area S(t) of the polishing cloth 14 to the semiconductor wafer W is $S_1$, i.e., $$S(t_1)=S_1=S_0$$

Therefore, the load of the polishing head 13 is $$L(t_1) = L_0 \cdot S_1 / S_0$$
$$= P \cdot S_1$$
$$= L_0$$

Finally, referring to FIG. 6C, the coordinate X of the center of the polishing cloth 14 becomes $$X(t_2)=X_e>X_m$$

where $X_e$ is 0.85R for example. In this case, the contact area S(t) of the polishing cloth 14 to the semiconductor wafer W becomes smaller, i.e., $$S(t_2)=S_2<S_1=S_0$$

Therefore, tile control circuit 21 reduces the load of the polishing head 13 to $$L(t_2) = L_0 \cdot S_2 / S_0$$

$$= P \cdot S_2$$

Also, note that it is desirable that the cycle period from time $t_0$ to time $t_2$ of the rocking operation is larger than the cycle period of revolution of the semiconductor wafer W.

Thus, since the load L(t) of the polishing head 13 is changed in accordance with the contact area S(t) of the polishing cloth 14 to the semiconductor wafer W, the polishing pressure P can be definite.

In addition, the contact area of the peripheral part of the polishing cloth 14 to the semiconductor wafer W is substantially reduced. In other words, the inner circular area of the polishing cloth 14 always contacts the semiconductor wafer W, while the annular areas of the polishing cloth 14 defined by the outer circle the long diameter "a" and the inner circle of the short diameter "b" intermittently contacts the semiconductor wafer W. Therefore, the relative increase of the polishing speed at and near the center of the semiconductor wafer W where it contacts the outer periphery of the polishing cloth 14 can be suppressed of the thus homogenizing the polishing power PP over the semiconductor wafer W.

Also, in FIGS. 6A, 6B and 6C, note that the control circuit 21 can store a relationship between the coordinate X(t) and the contact area S(X(t)) as a table in a memory. In this case, the control circuit 21 detects the current coordinate X(t) of the polishing cloth 14, and then, calculates the contact area S(t) of the polishing cloth 14 to the semiconductor wafer W by using the above-mentioned table. Then, the control circuit 21 calculates the load L(t) by $$L(t)=P \cdot S(t)$$

where P is the definite polishing pressure.

Figure 7:
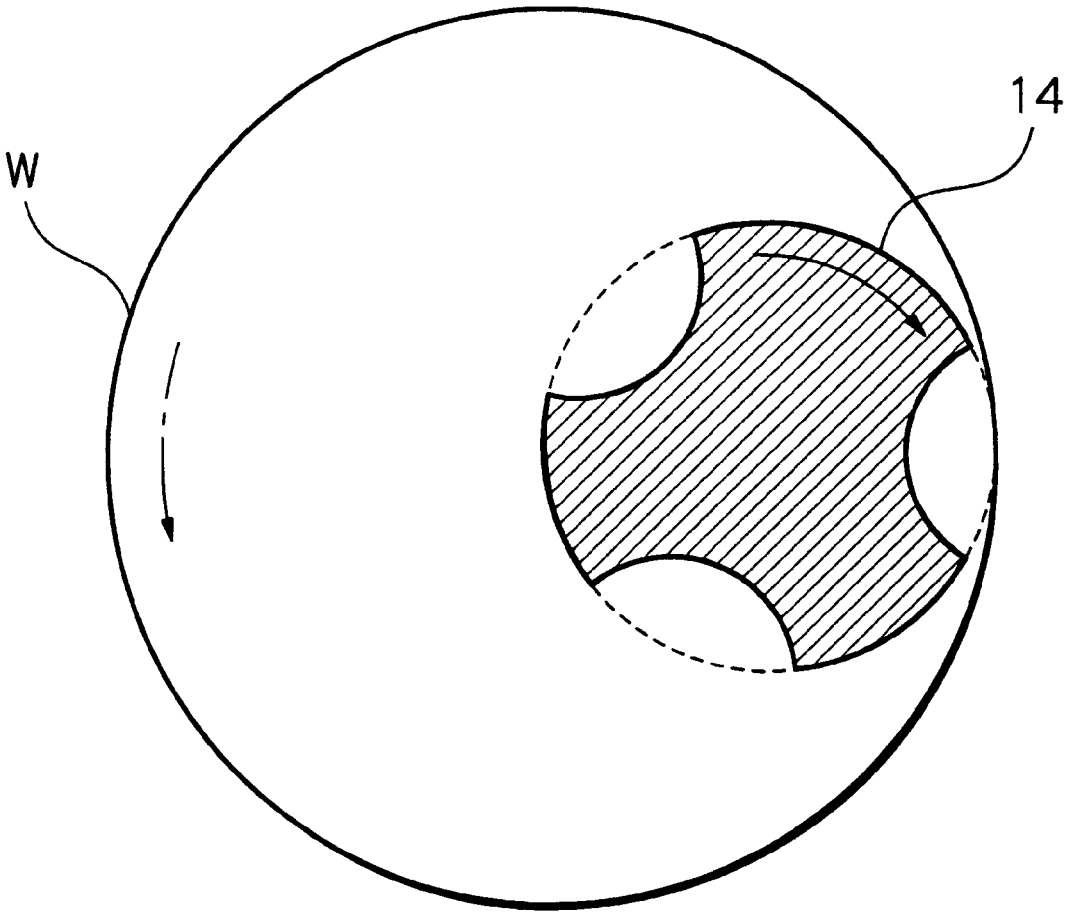
FIG. 7 is a diagram illustrating a modification of the polishing cloth in FIGS. 6A, 6B and 6C.

Further, in FIGS. 6A, 6B and 6C, the elliptic polishing cloth 14 can be replaced by other non-circular polishing cloths. For example, as illustrated in FIG. 7, such a non-circular polishing cloth is obtained by partly cutting out areas of the outer periphery of a circular polishing cloth. In this case, the radius of an equivalent circle having the same area as the non-circular polishing cloth is calculated in advance. Therefore, the control circuit 21 can calculate the contact area S(t) of the non-circular cloth 14 to the semiconductor wafer W by using the coordinate X(t) and the radius of the equivalent circle.

Figure 8:
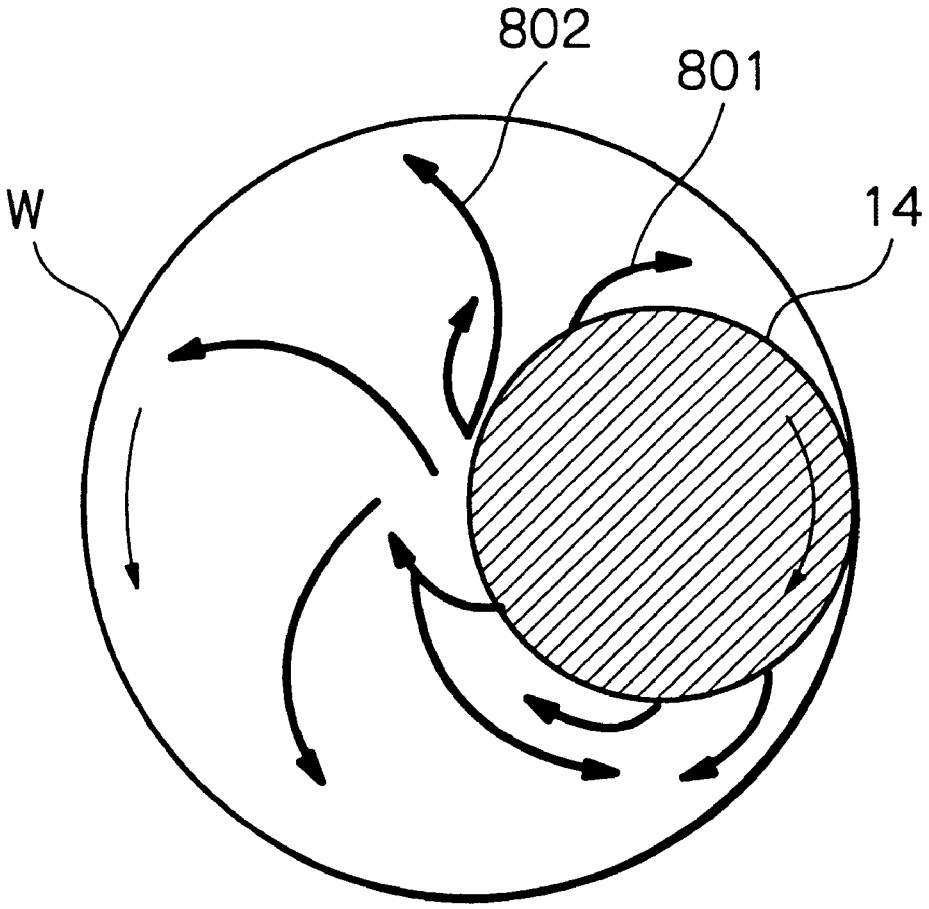
FIG. 8 is a diagram for explaining the flow of polishing liquid in the CMP apparatus of FIG. 4.

In FIG. 8, which illustrates the flow of polishing liquid in the CMP apparatus of FIG. 4, the polishing cloth 14 and hence the polishing head 13 are made to rotate in a direction opposite to the rotating direction of the semiconductor wafer W. Additionally, the absolute value of the rate of revolution of the polishing head 13 is preferably at least twice of that of the semiconductor wafer W. As a result the flow of polishing liquid as indicated by arrows 801 caused by the centrifugal force generated by the polishing cloth 14 is directed oppositely relative to the flow of polishing liquid as indicated by arrows 802 caused by the centrifugal force generated by the semiconductor wafer W, so that the two flows counter each other to make polishing liquid stay for a long time on the surface of the semiconductor wafer W. Thus, the rate of supply of polishing liquid can be reduced.

The invertors operated the CMP apparatus of FIG. 4 under the following conditions;

- the diameter of the semiconductor wafer W having a silicon oxide layer thereon was 200 mm;
- the rotational speed of the semiconductor wafer W was 30 rpm in the counter-clockwise direction;
- the diameter of the circular polishing clothe 14 made of trademark IC1000/suba400 layer pad with a gridwork of 1.5 mm wide grooves arranged at a pitch of 5 to 10 mm was 106 mm;
- the load L(t) of the polishing head 13 was definite and was 26.3 kgw;
- the start coordinate $X_s$ of the rocking operation was 50 mm; and
- the rate of supply of polishing liquid made of colloidal silica particles into pure water by 20 wt % was 50 cc/min.

Figure 9A:
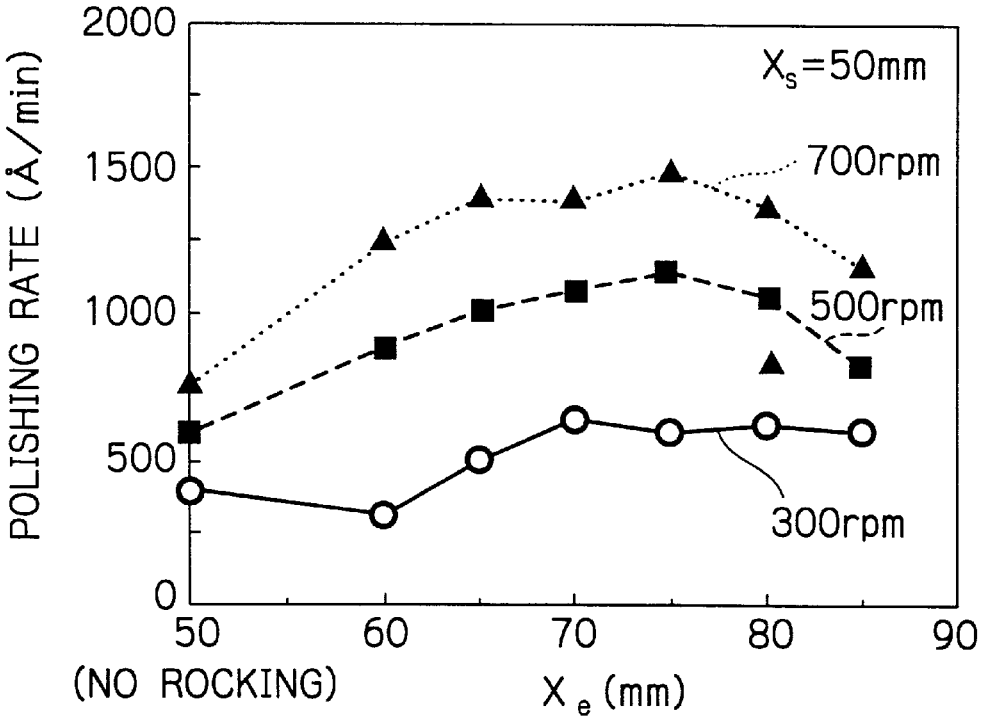
FIG. 9A is a graph showing the relationship between the rocking distance and the polishing rate when using a circular polishing cloth in the CMP apparatus of FIG. 4 under the condition that the load of the polishing head is definite.
Figure 9B:
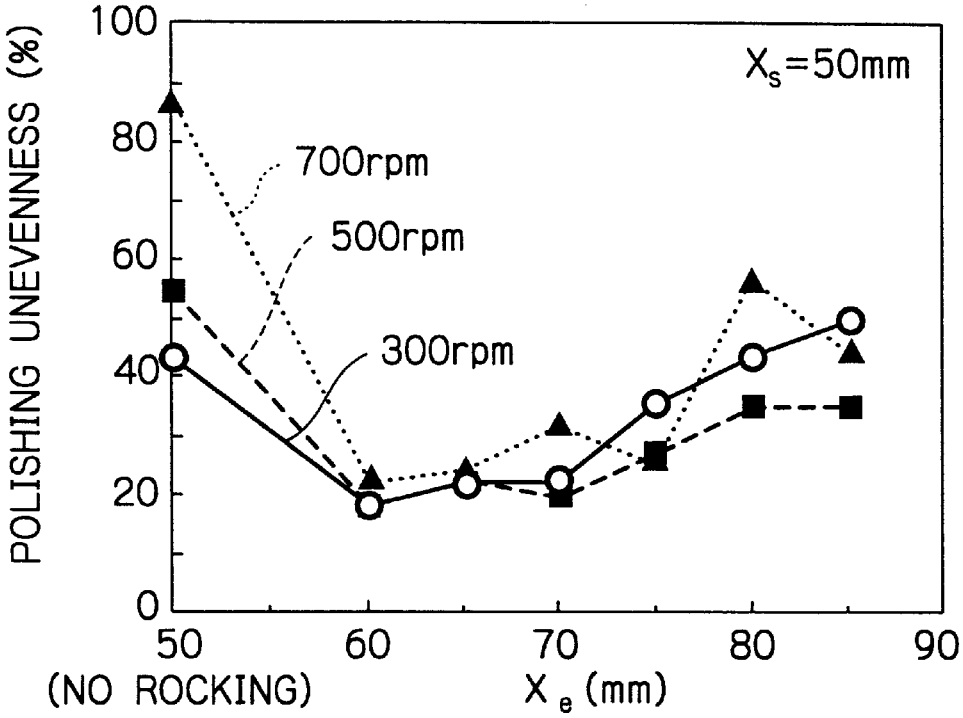
FIG. 9B is a graph showing the relationship between the rocking distance and the polishing unevenness when using a circular polishing cloth in the CMP apparatus of FIG. 4 under the condition that the load of the polishing head is definite.

Under the above-mentioned conditions, i.e., under a definite load while the diameter of the circular polishing cloth 14 was approximately half of the semiconductor wafer W, as shown in FIG. 9A, the polishing rate was increased at any rate of revolution of the polishing cloth 14 by the rocking operation. However, the polishing rate tended to fall when the rocking distance ($=X_e-X_s$) exceeded 30 mm. Also, as shown in FIG. 9B, under the condition that the rocking speed was 330 m/min, the polishing unevenness was remarkably decreased by the rocking operation. However, the polishing unevenness was again increased when the rocking distance ($=X_e-X_s$) was increased. For, example, when the rate of revolution of the polishing cloth 14 in the clockwise direction was 300 rpm, the polishing unevenness was as high as 41% under no rocking operation, but the polishing unevenness was reduced to ±20% by the rocking operation of the rocking distance 10 mm ($X_e$=60 mm).

However, it was found that the silicon oxide layer on the semiconductor water W had been thinned locally at a central area thereof and this tendency did not change when the rocking distance was increased to 20 mm ($X_e$=70 mm). Thus, the polishing unevenness remained at the level of ±20% . When the rocking distance was increased further, the polishing rate was increased remarkably along the outer periphery of the semiconductor wafer W to consequently increase the polishing unevenness once again. This was because, when the rocking distance exceeded 20 mm ($X_e$=70 mm), the polishing cloth 14 moved out of the outer periphery of the semiconductor wafer W partly but significantly to reduce the contact area of the polishing cloth 14 to the semiconductor wafer W so that the effective polishing pressure P was raised to a nonnegligible extent.

Thus, while the polishing uniformity can be improved and the polishing rate can be raised by the rocking operation within the face of the semiconductor wafer W, the extent to which the polishing cloth 14 moves out of the outer periphery of the semiconductor wafer W becomes nonnegligible when the rocking distance ($X_e-X_s$) is raised excessively to consequently increase the effective polishing pressure P with the increase of the rocking distance of the polishing cloth 14 if a constant load is used for polishing.

Thus, in the polishing apparatus of FIG. 4 adapted to polish the face of the semiconductor wafer W, a function of compensating for the effect of the polishing cloth 14 moving out of the outer periphery of the semiconductor wafer W in order to produce a constant polishing pressure is indispensable.

Figure 10:
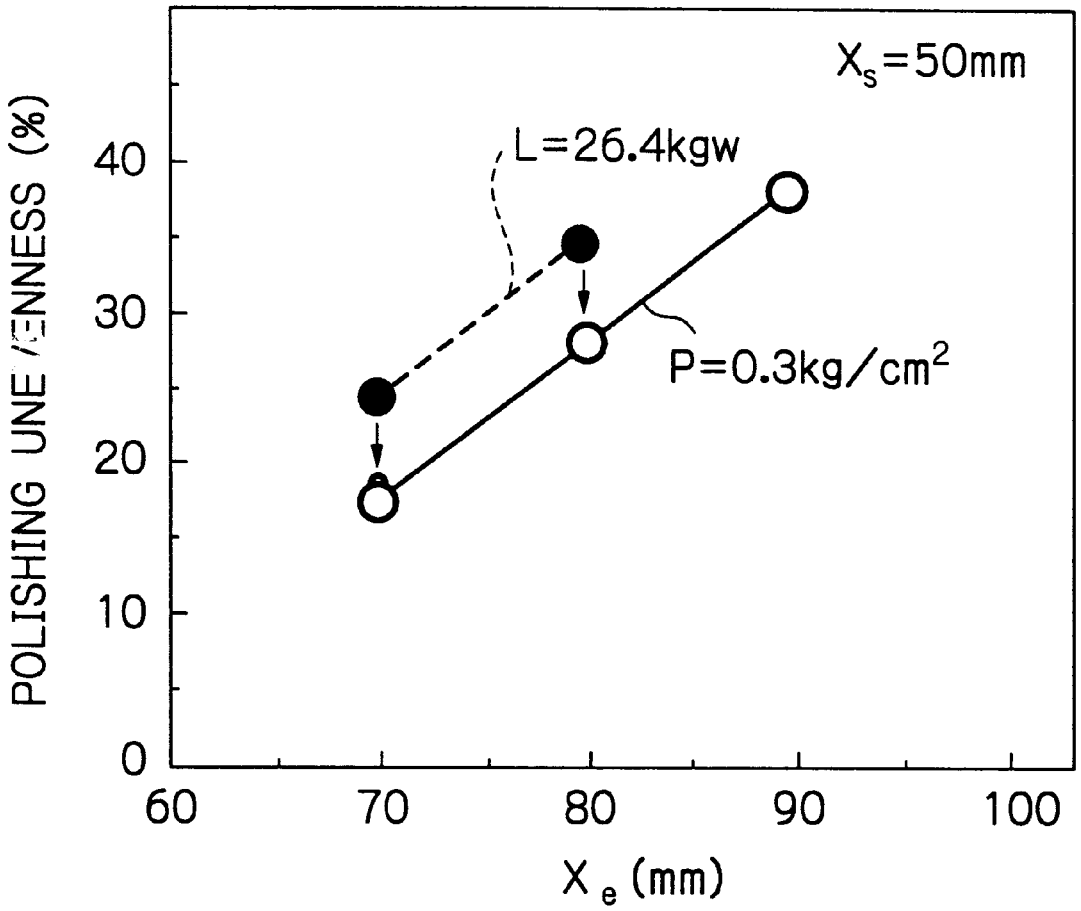
FIG. 10 is a graph showing the relationship between the rocking distance and the polishing rate when using a circular polishing cloth in the CMP apparatus of FIG. 4 under the condition that the polishing pressure is definite.

Under the above-mentioned conditions, the polishing pressure P was caused to be definite and was 0.3 kg/cm$^2$ instead of the definite load L(t) of the polishing head 13. That is, the load L(t) of the polishing head 13 was changed in accordance with the contact area S(t) of the polishing cloth 14 to the semiconductor wafer W so that the polishing pressure P (=L(t)/S(t)) was made definite. As a result, as shown in FIG. 10, in the case of using a circular polishing cloth, it was found that the polishing unevenness could be reduced by correcting the area by which the polishing cloth 14 moved out of the semiconductor wafer W to keep the polishing pressure P constant if compared with the use of a constant load. This represents a result obtained by correcting abnormal polishing at and near the outer periphery of the semiconductor wafer W, although the polishing unevenness became remarkable once again when the rocking distance ($=X_e-X_s$) exceeded 30 mm. Additionally, the polishing unevenness remained as large as ±17% when the rocking distance ($=X_e-X_s$) was reduced to 20 mm. As a result of analyzing the distribution of polishing rate within the surface of the semiconductor wafer, it was found that the polishing rate was high in a central area and also in an outer peripheral area of the semiconductor wafer W even after correcting the unevenness of the polishing cloth 14 to realize a constant polishing pressure. Thus, it was made clear that the polishing unevenness was caused not only by fluctuations in the polishing pressure but also by an increase in the relative polishing rate of a central area and an outer peripheral area of the semiconductor wafer W that contacted an outer peripheral portion of the polishing cloth 14 that was revolving at a rate greater that any other remaining portions of the polishing cloth 14.

Figure 11:
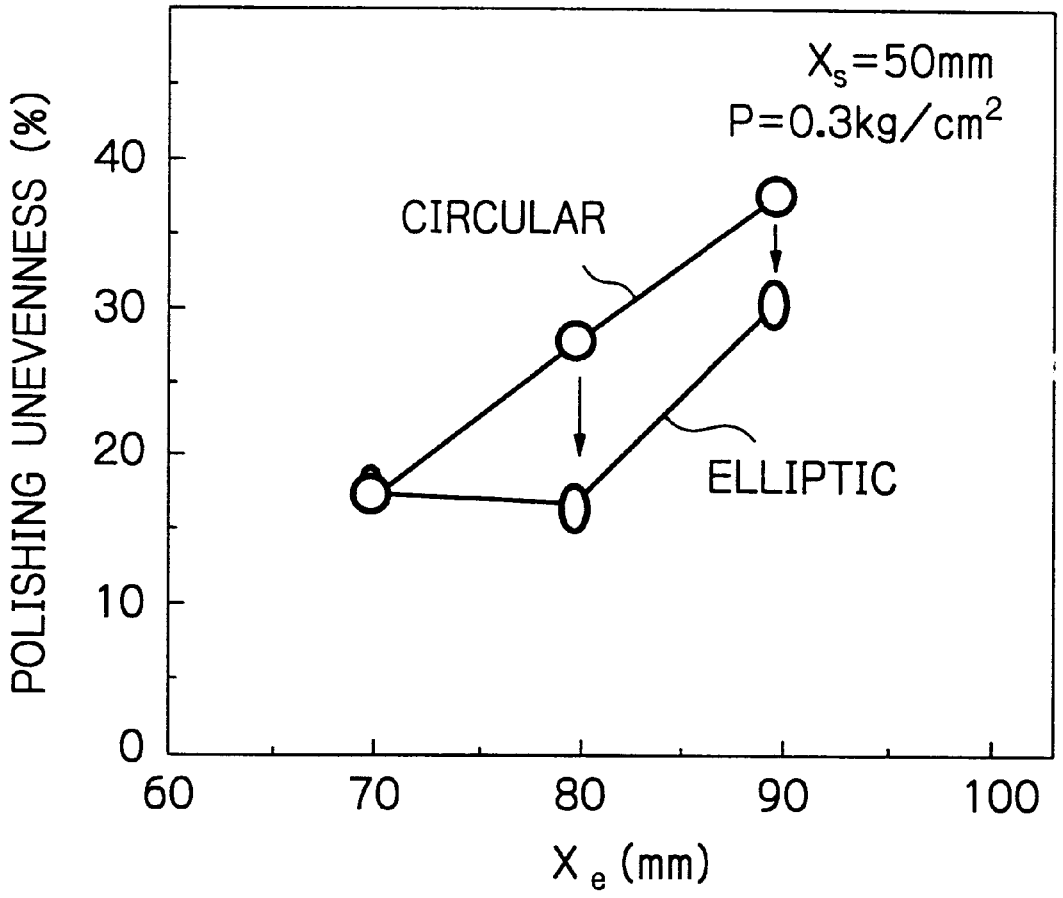
FIG. 11 is a graph showing the relationship between the rocking distance and the polishing unevenness when using an elliptic polishing cloth in the CMP apparatus of FIG. 4 under the condition that the polishing pressure is definite.

In order to alleviate the relative polishing rate of the central area and outer peripheral area of the semiconductor wafer W, an outermost peripheral portion of the circular polishing cloth 14 was cut out to produce an elliptic polishing cloth, which was then used to polish the semiconductor wafer W. For example, the elliptic polishing cloth 14 had a long diameter of 100 mm and a short diameter of 80 mm. As a result, as shown in FIG. 11, it was found that the increase in the relative polishing rate in the central area and the outer peripheral area was alleviated to further improve the polishing unevenness to a level of ±5% even when the rocking distance of 30 mm ($X_e$=80 mm) was selected. In FIGS. 10 and 11, note that the rotational speed of the polishing cloth 14 in the clockwise direction is 400 rpm.

Figure 12:
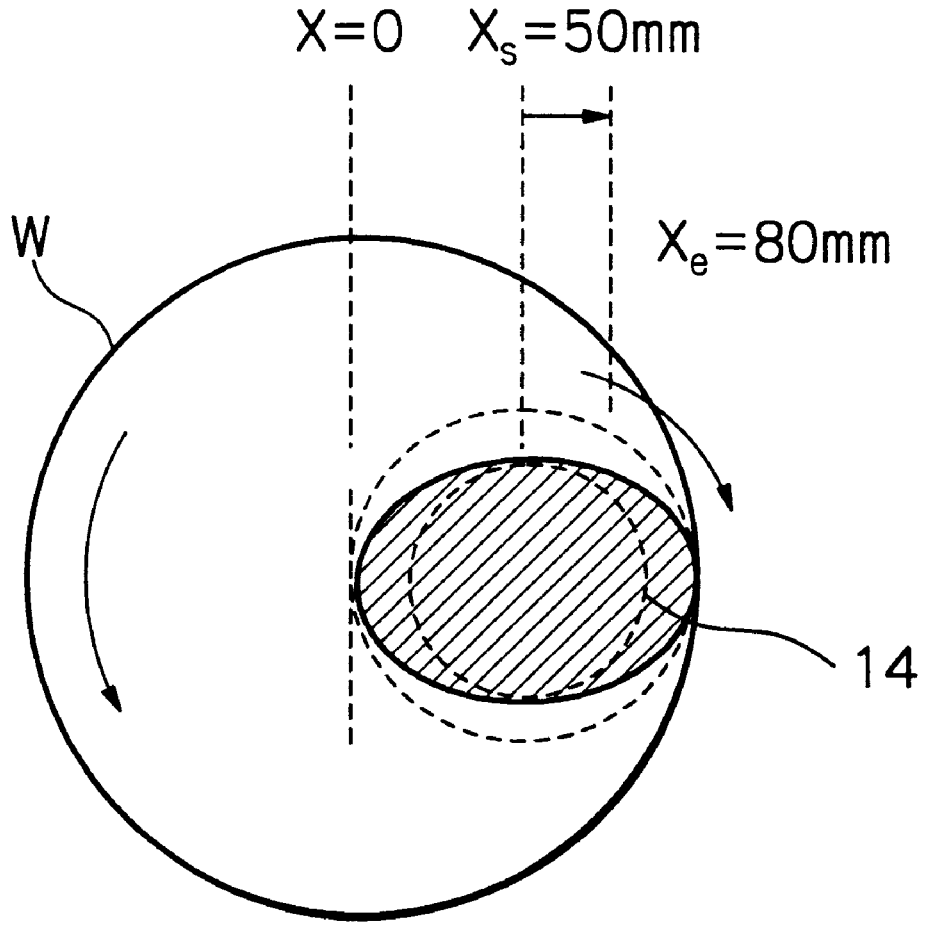
FIG. 12 is a diagram illustrating a rocking distance using an elliptic polishing cloth in the CMP apparatus of FIG. 4.

Meanwhile, as shown in FIG. 12, when $X_s$=50 mm was selected for the point of starting the rocking motion of the elliptic polishing cloth 14 with a long diameter of 100 mm and a short diameter of 80 mm, the center of the semiconductor wafer W was polished only when the two apexes of the elliptic polishing cloth 14 passed there. As a result, the polishing rate at the center of the semiconductor wafer W was relatively reduced when the elliptic polishing cloth 14 was used.

When the elliptic polishing cloth 14 is not rocking, the elliptic polishing cloth 14 constantly contact the semiconductor wafer W in the inside of the inner circle and, in the region between the outer circle and the inner circle, the time of contact of the elliptic polishing cloth 14 to the semiconductor wafer W relatively decreases near the outer circle. As showing in FIG. 13, the relative contact time o f the center of the semiconductor wafer W and the elliptic polishing cloth 14 can be regulated by moving the starting point $X_s$ of the rocking motion of the elliptic polishing cloth 14 toward the center of the semiconductor wafer W.

Figure 13A:
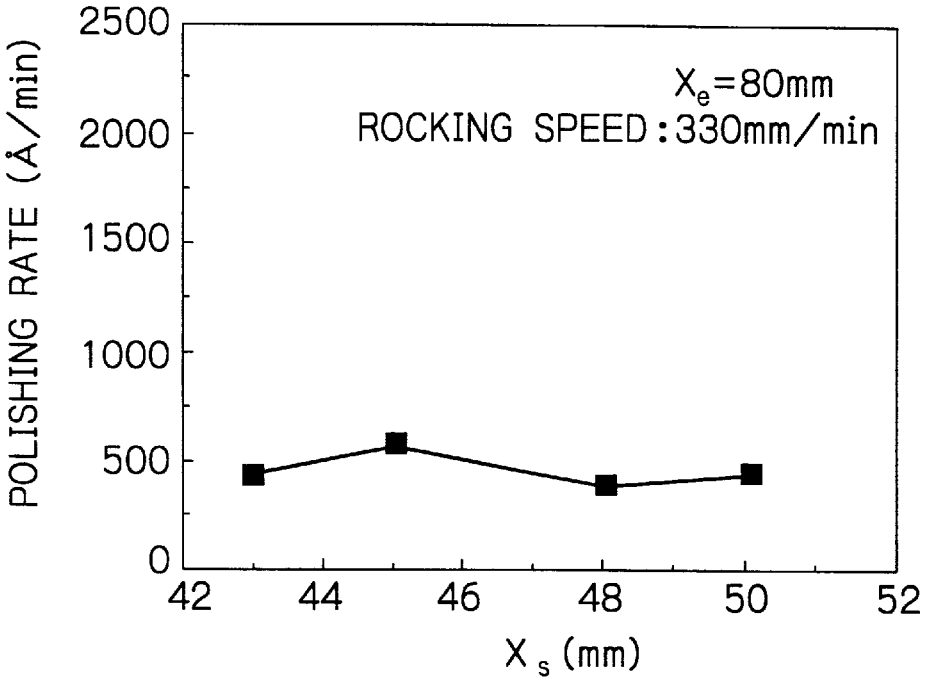
FIG. 13A is a graph showing the relationship between the starting point of the rocking distance and the polishing rate when using an elliptic polishing cloth in the CMP apparatus of FIG. 4 under the condition that the polishing pressure is definite.
Figure 13B:
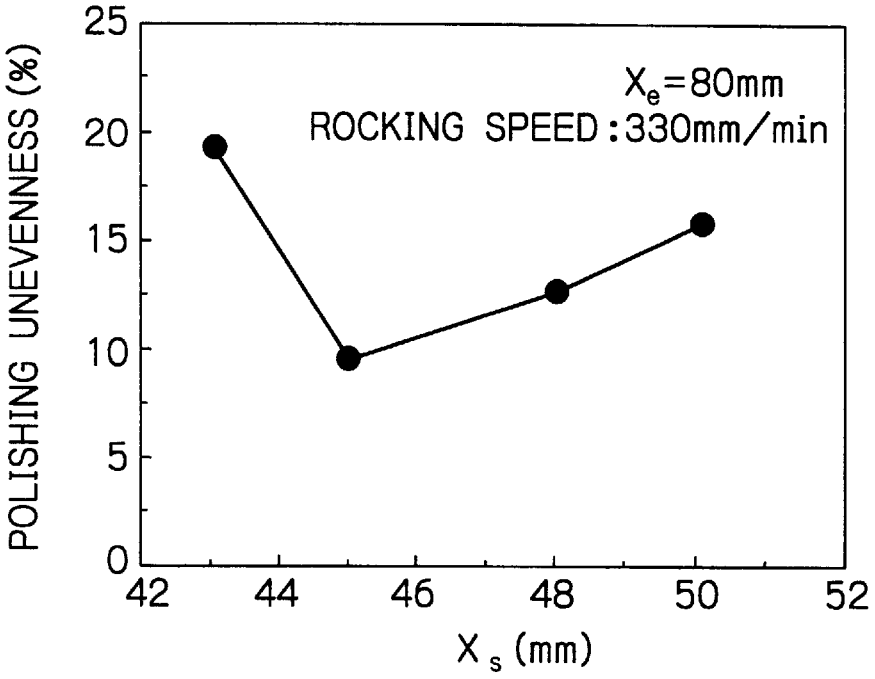
FIG. 13B is a graph showing the relationship between the starting point of the rocking distance and the polishing unevenness when using an elliptic polishing cloth in the CMP apparatus of FIG. 4 under the condition that the polishing pressure is definite.

FIGS. 13A and 13B are graphs showing the effect of the star point $X_s$ of the rocking motion on the polishing unevenness obtained when an elliptic polishing cloth with a long diameter of 100 mm and a short diameter of 80 mm was used. Here, the end point $X_e$ of rocking motion was held to 80 mm and the polishing pressure P was also held constant (0.3 kg/cm$^2$) by taking the motion of the elliptic polishing cloth 14 partly moving out of the semiconductor wafer W as a result of the rocking operation of the elliptic polishing cloth 14 into consideration.

The polishing unevenness was reduced by bringing the start point $X_s$ of the rocking operation close to the center of the semiconductor wafer W, i.e., by reducing the starting point $X_s$ The polishing unevenness was minimized to $X_s$=45 mm. In other words, if the starting point $X_s$ was further brought close to the center of the semiconductor wafer W, the relative polishing rate of the center of the semiconductor wafer was increased once again to consequently increase the polishing unevenness.

Thus, in the case of an elliptic polishing cloth, while the short diameter should be smaller than half of diameter of the semiconductor wafer W to be polished, the long diameter a is not subjected to any limitations. For example, for polishing a semiconductor wafer with a radius of R, an optimum effect can be produced when the short diameter of the elliptic polishing cloth is between 0.9R and 0.7R and the long diameter is between 1.0R and 1.5R. The starting point $X_s$ of the rocking motion (the origin of the coordinate of the elliptic polishing cloth) that is located on a radial line passing through the center of the semiconductor wafer W may be such that the center of the semiconductor wafer W is located between the annular belt defined by an outer circle and an inner circle of the elliptic polishing cloth. In other words, $$0.5b \leqq X_s \leqq 0.5a$$

where "a" is a long diameter of the elliptic polishing cloth 14; and

"b" is a short diameter of the elliptic polishing cloth 14.

The relationship rotational speed of the semiconductor wafer W and the polishing rate will be explained next with reference to FIG. 14A.

Figure 14A:
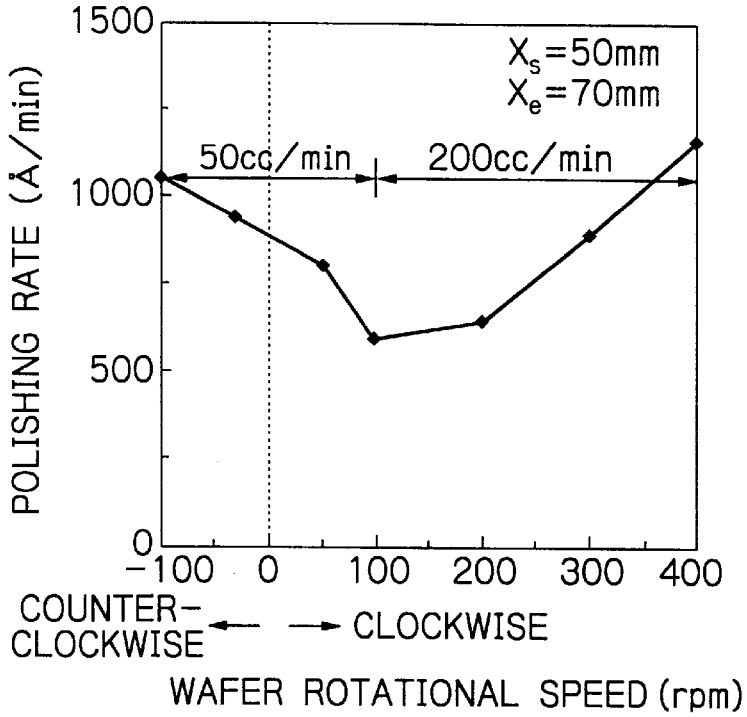
FIG. 14A is a graph showing the relationship between the wafer rotational speed and the polishing rate when using a circular polishing cloth in the CMP apparatus of FIG. 4 under the condition that the polishing pressure is definite.

In FIG. 14A, the CMP apparatus of FIG. 4 was operated under the following conditions:

- the diameter of the semiconductor wafer W having a silicon oxide layer thereon was 200 mm;
- the diameter of the circular polishing cloth 14 made of trademark IC1000/suba400 layer pad with a gridwork of 1.5 mm wide grooves arranged at a pitch of 5 to 10 mm was 106 mm;
- the start coordinate $X_s$ of the rocking operation was 50 mm;
- the end coordinate $X_e$ of the rocking operation was 70 mm;
- the rocking speed was 330 mm/min; and
- the polishing pressure P was 0.3 kg/cm$^2$.

As shown in FIG. 14A, when the semiconductor wafer W was driven to rotate counterclockwise at a speed of 100 rpm (indicated as −100 rpm), the silicon oxide layer on the semiconductor wafer W was polished at a rate of 100 Å/min. When the wafer rotational speed was reduced to −30 rpm, the polishing rate was also reduced slightly. Then, the polishing rate was reduced monotonically until the semiconductor wafer W became driven clockwise the same as the polishing cloth 14 until 200 rpm. This is because, when the polishing cloth 14 has a diameter equal to a half of the diameter of the semiconductor wafer W to be polished, the peripheral speed of the polishing cloth 14 revolving at 400 rpm is equal to the peripheral speed of the semiconductor wafer W revolving at 200 rpm, so that the polishing power PP is reduced significantly.

Thereafter, the polishing rate came to show an increase. However, when the wafer rotational speed exceeded 100 rpm, the surface being polished became damaged with a rate of supply of polishing liquid of 50 cc/min, so that the rate of supply of polishing liquid had to be increased to 200 cc/min. The surface being polished was not damaged when the semiconductor wafer W was driven to rotate at 100 rpm oppositely relative to the polishing cloth 14 (therefore −100 rpm).

This means that the rotating direction of the semiconductor wafer W and that of the polishing cloth 14 are strongly related. While the centrifugal force applied to the polishing liquid on the semiconductor wafer W by the rotating wafer does not depend on the rotating direction, the rotating polishing cloth 14 is located above the semiconductor wafer and the polishing liquid is also affected by the centrifugal force generated by the rotating polishing cloth 14. When both the semiconductor wafer W and the polishing cloth 14 are driven to rotate in the same direction, polishing liquid flows on the semiconductor wafer W in a fixed direction by the combined centrifugal force, so that the polishing liquid is acceleratedly dispersed from the surface of the semiconductor wafer W. This may be the reason why polishing liquid had to be supplied at an enhanced rate in the above experiment.

The relationship between the rotational speed of the semiconductor wafer W and the polishing unevenness will be explained next with reference to FIG. 14B.

Figure 14B:
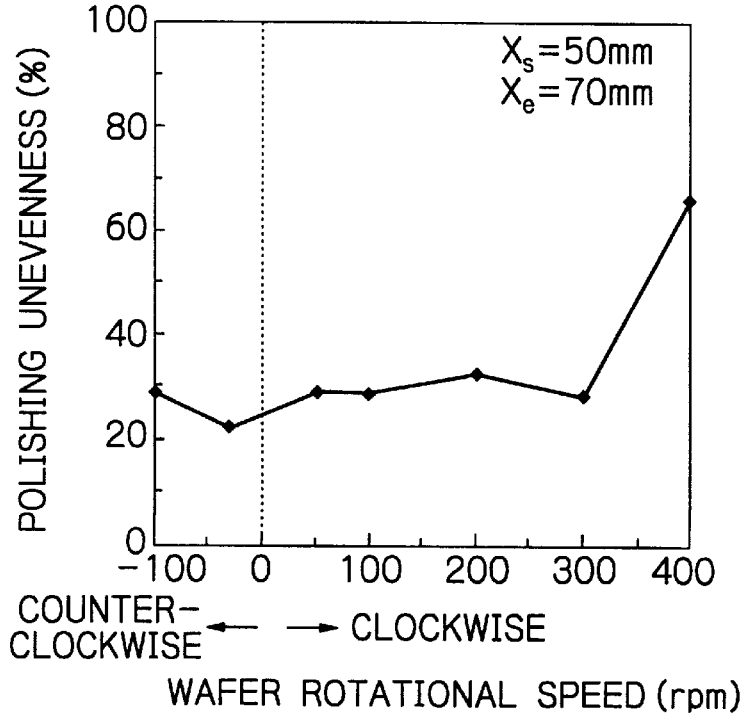
FIG. 14B is a graph showing the relationship between the wafer rotational speed and the polishing unevenness when using a circular polishing cloth in the CMP apparatus of FIG. 4 under the condition that the polishing pressure is definite.

In FIG. 14B, the CMP apparatus of FIG. 4 was operated in the same conditions as in FIG. 14A.

As shown in FIG. 14B, the polishing unevenness was minimized when the semiconductor wafer W was rotating at a speed of −30 rpm, and was increased as the rotational speed of the semiconductor wafer W in the same direction as that of the polishing cloth 14 was increased. Particularly, the polishing unevenness became remarkable when the semiconductor wafer W and the polishing cloth 14 were driven to rotate in the same direction at 400 rpm.

Thus, it is very important that the polishing cloth 14 and the semiconductor wafer W are driven to rotate in opposite directions to each other, in order to carry out a high speed polishing operation, using polishing liquid efficiently and economically, without damaging the surface of the semiconductor wafer W.

An automatic polishing apparatus to which the CMP apparatus of FIG. 4 is applied will be explained next with reference to FIGS. 15, 16 and 17. The automatic polishing apparatus is adapted to perform a primary polishing operation and a second polishing operation upon a semiconductor wafer.

Figure 15:
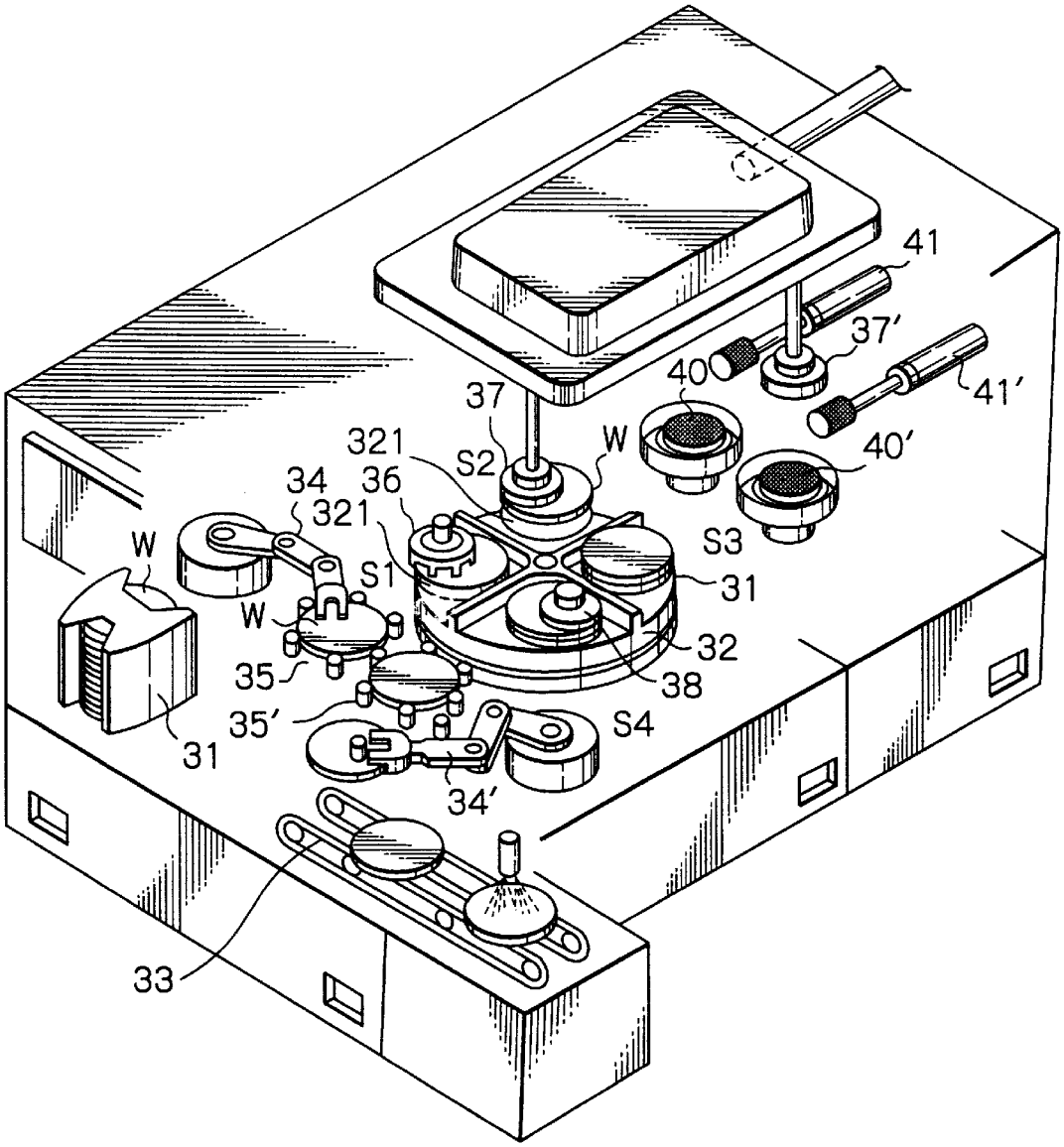
FIG. 15 is a partly cut perspective automatic polishing apparatus to which the CMP apparatus of FIG. 4 is applied.

In FIG. 15, reference numeral 31 designates a wafer carrier, 32 designates an index table, and 33 designates a wafer conveyer.

The index table 32 is partitioned into a wafer loading station S1, a primary polishing station S2, a secondary polishing station S3 and a wafer unloading station S4.

Note that the stations S1 through S4 are allocated respective stop positions of the indexing table 32. Therefore, the index table 32 has four holders 321 for holding semiconductor wafers W, and sequentially feeds each of the semiconductor wafers W to the stations, S1, S2, S3 and S4 as it turns by 90°.

The wafer loading station S1 is a region for moving semiconductor wafers W onto the index table 32 and the unloading station S4 is a region for moving semiconductor wafers W out of the index table 32. The primary polishing station S2 refers to a region where the semiconductor wafers W moved onto the index table 32 are subjected to a planarizing process, whereas the secondary polishing station S3 refers to a region where the semiconductor wafers W are finished after completing the planarizing process.

At the wafer loading station S1, the semiconductor wafers W stored in the wafer carrier 31 are taken out one by one by a robot arm 34 onto a pin clamp 35 and washed at the rear surface by a wafer rear side cleaning brush (not shown). At the same time, the surface of the holder 321 of the wafer loading stations S1 is scraped and cleansed by a rotary ceramic plate 36 while it is supplied with pure water.

The semiconductor wafer W with a cleaned rear surface is then moved onto the holder 321 of the loading station S1 that has a cleansed surface and firmly and securely adsorbed by a vacuum chuck. Then, as the index table 32 is turned by 90°, the semiconductor wafer W on the holder 321 is moved into the primary polishing station S2.

At the primary polishing station S2, the semiconductor wafer W is subjected to a planarizing process performed by a polishing head 37 and then moved to the secondary polishing station S3, where it is subjected to a finishing process performed by another polishing head 37' and then moved to the wafer unloading station S4, where the polished surface of the semiconductor wafer W is roughly cleaned by means of a wafer front side cleaning brush 38.

After the rough cleaning, the semiconductor wafer W is moved from the holder 321 onto the pin clamp 35', where its rear surface is roughly cleaned by means of a wafer rear side cleaning brush (not shown). Subsequently, the semiconductor wafer W is moved onto the wafer conveyer 33 that leads to a precision wafer cleaning unit (not shown) by means of another robot arm 34'. Meanwhile, the index table 32 is turned by 90° to return the holder 321 that is now free from the semiconductor wafer W to the wafer loading station S1 and becomes ready for receiving the next wafer W.

Also, the primary polishing station S2 and the secondary polishing station S3 are provided respectively with pad conditioners 40 and 40', and pad cleaning brushes 41 and 41'.

Figure 16:
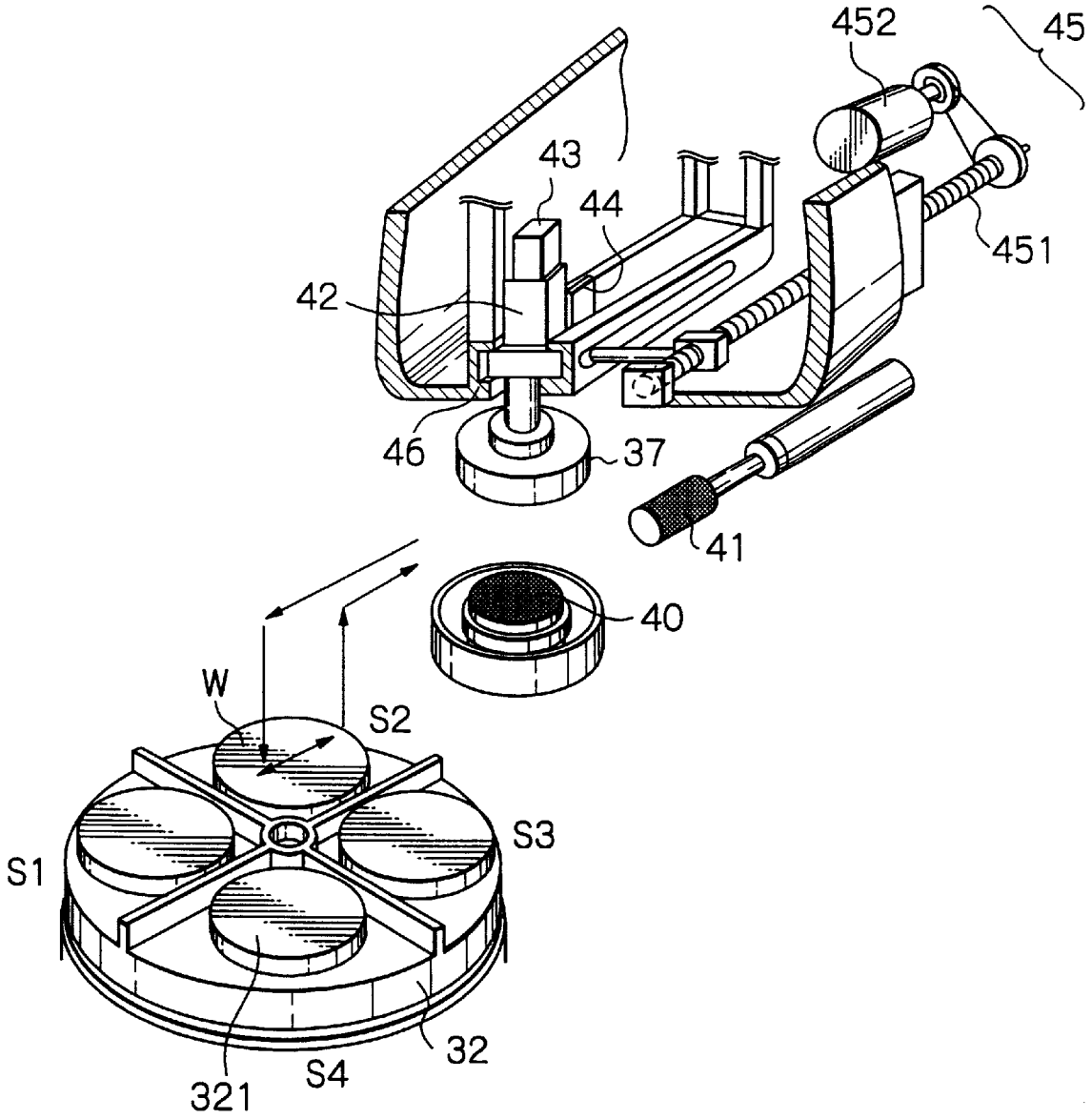
FIG. 16 is a perspective view of a part of the apparatus of FIG. 15.
Figure 17:
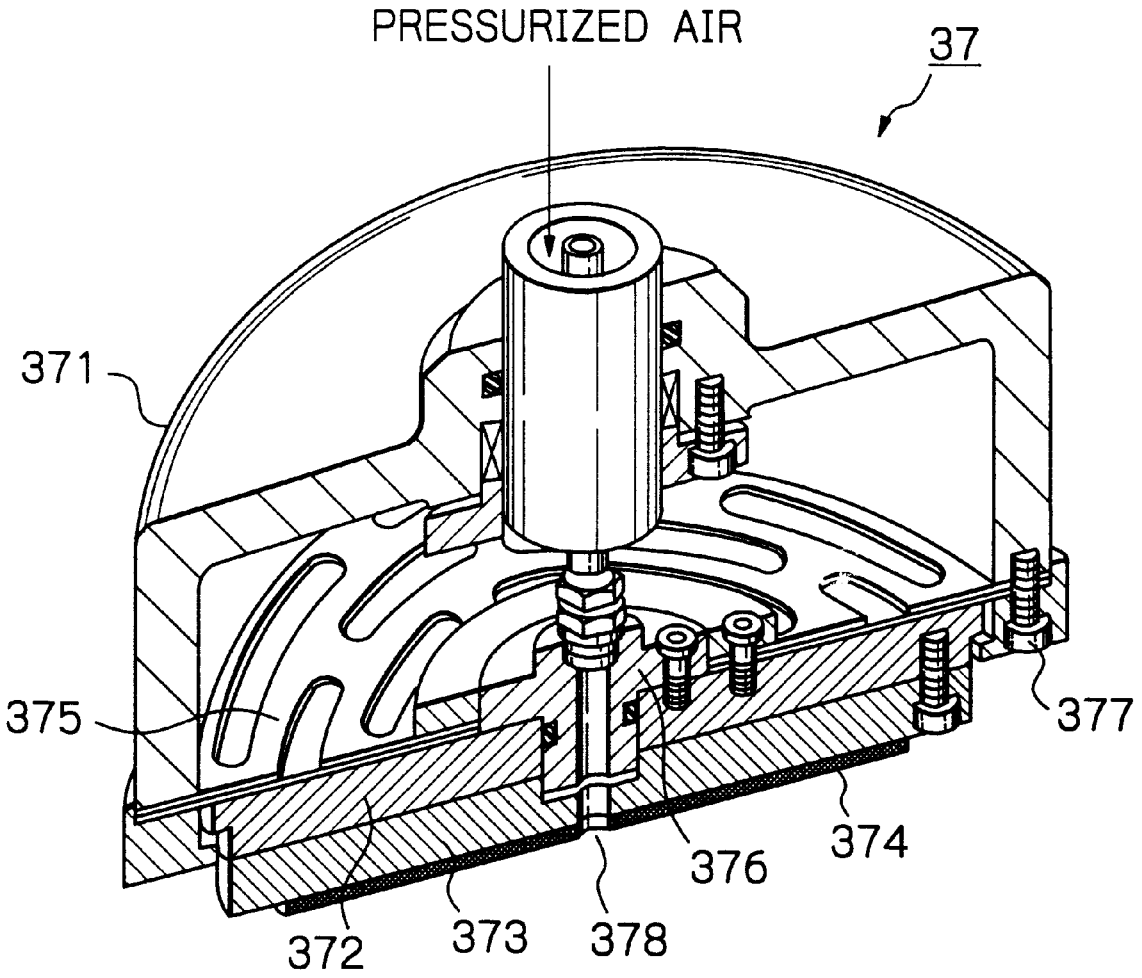
FIG. 17 is a cross-sectional view of the polishing head of FIG. 15.

In more detail, referring to FIG. 16, the pad conditioners 40 and 40' are used to cleanse the surface of the polishing cloths 374 shown not in FIG. 16 but in FIG. 17 bonded to the bottom of the polishing head 37.

The polishing head 37 carrying the polishing cloth on the bottom (plate with a polishing pad bonded thereto) is set in position on a carrier 42, which is provided with an air cylinder 43 for vertically moving up and down the polishing head 37 and a rotary drive motor 44 for driving the polishing head 37 to rotate. A carrier rocking drive section 45 is arranged along a rail 46.

In the rocking drive section 45, a feed screw 451 rotates as it is driven by a feed drive mechanism (motor) 452 of the carrier 42, so that the carrier 42 is moved from a standby position along the rail 46 onto the holder 321 of the primary polishing station S2 by the rotating feed screw 451. Then, it moves down along the holder 321 under the control of the air cylinder. Thus, the polishing head 37 is made to rotate under the control the rotary drive motor 44, while linearly moving along the rail 46, to consequently show a rocking motion on the semiconductor wafer W that is rotating on the holder 321.

The rocking drive section 45 accurately detects the coordinate of the center of the polishing head 37 and controls the feeding rate and the rocking range thereof. Additionally, it transmits data on the coordinate of the center of the polishing head 37 to the control circuit 21.

In more detail, referring to FIG. 17, which is a detailed cross-sectional view of the polishing head 37 of FIG. 15, the polishing head 37 is constructed by a pressure cylinder 371, a base plate 372 and a plate 373 with a polishing cloth 374. Also, a drive plate 375 and a diaphragm 376 are arranged between the pressure cylinder 371 and the base plate 372, and the multilayer structure of the drive plate 375 and the diaphragm 376 is supported by a flange at the outer periphery thereof while the pressure cylinder 371 is securely held by a bolt 377 at the lower edge thereof.

The plate 373 with the polishing cloth 374 is rigidly fitted to the base plate 372. The polishing cloth 374 is made of membrane of a hard polymer such as foamed polyurethane.

The diaphragm 376 is used to keep the inside of the pressure cylinder 371 and the gap between the pressure cylinder 371 and the base plate 372 airtight and is arranged so as to follow any three-dimensional change in the direction of the base plate 372. It also reinforced the strength of the base plate 372. According to the present invention, the load to be applied onto a semiconductor wafer is controlled by controlling the pressure of the pressure chamber 371 of the polishing head 37.

As the pressure cylinder 371 is flexibly supported, the polishing head 37 can have a three-dimensional clearance so that, any change in the polishing load attributable to slight mechanical inaccuracy of the rail 46 such as slight possible discrepancy in the parallelism of the rail 46 and the wafer surface can be compensated for. As a result, if the polishing head 37 is made to rock, it can constantly apply a predetermined load to semiconductor the wafer W.

In FIG. 17, reference numeral 378 designates a polishing liquid supply hole.

In FIGS. 15, 16 and 17, it may be obvious that a polishing method according to the present invention is not only effective for a primary polishing process but also for a secondary polishing process. A polishing process as used herein refers to a process of planarizing the surface layer of a semiconductor wafer or a semiconductor wafer per se, and also to a burying/planarizing process for burying a metal layer or an insulating layer into the grooves of a semiconductor wafer. Also, an elliptic polishing cloth is used for the primary polishing process and a circular polishing cloth is used for the secondary polishing process. The polishing rate will be low in a central area and in an outer peripheral area of the semiconductor wafer when an elliptic polishing cloth is used, whereas the polishing rate will be contrarily high in those areas when a circular polishing cloth is used. Thus, polishing cloths with different contours may be used respectively for the primary polishing process and the secondary polishing process to offset the differentiated polishing rate distribution, so that the entire surface of the semiconductor wafer may be polished highly uniformly. It may be needless to say that, conversely, a circular polishing cloth may be used for the primary polishing process and an elliptic polishing cloth may be used for the secondary polishing process to realize the same effect.

In the above-mentioned embodiment, although the surface layer made of silicon oxide on a semiconductor wafer was polished and paganized, there are no limitations for the material of the wafer surface layer for the purpose of the present invention. Film materials that can be used for the surface layer of a semiconductor wafer to be planarized and polished by the polishing apparatus according to the present invention include metals such as aluminum, copper, tungsten, tantalum, niobium and silver, alloys such as TiW, metal silicides such as tungsten silicide and titanium silicide, metal nitrides such as tantalum nitride, titanium nitride and tungsten nitride and polycrystalline silicon.

Additionally, materials that can be used for the surface layer of a wafer to be planarized and polished by the polishing apparatus according to the present invention further include organic polymers with a low dielectric constant such as polyimide, amorphous carbon, polyether, benzocylobutane.

Further, polishing liquid that can be used for the purpose of the present invention may be dispersed solution of silica fine particles, alumina fine particles or cerium oxide fine particles.

As explained hereinabove, according to the present invention, since the polishing pressure can be definite over a semiconductor wafer, any polishing unevenness can be minimized. Also, since the semiconductor wafer and the polishing cloth are driven to rotate in opposite directions, polishing liquid can be used efficiently and economically to dramatically reduce the rate of consumption of polishing liquid and hence the cost of polishing a semiconductor wafer. A low rate of supplying polishing liquid to the semiconductor wafer facilitates the operation of removing polishing liquid from the part of the surface of the semiconductor wafer being polished and improves the accuracy of detecting the terminal point of the polishing operation.

What is claimed is:

1. An apparatus for polishing a substrate, comprising:

a polishing platen for mounting said substrate;

a polishing head;

a polishing pad adhered to a bottom face of said polishing head;

a rocking section, connected to said polishing head, for rocking said polishing head with respect to said polishing platen; and a control circuit, connected to said polishing head and said rocking section, for controlling a load of said polishing pad applied to said substrate in accordance with a contact area of said polishing pad to said substrate.

2. The apparatus as set forth in claim 1, wherein said control circuit calculates the contact area of said polishing pad to said substrate and calculates the load of said polishing pad by multiplying the contact area of said polishing pad to said substrate by a constant polishing pressure value.

3. The apparatus as set forth in claim 1, wherein a diameter of said polishing pad is approximately half of a diameter of said substrate.

4. The apparatus as set forth in claim 1, wherein said polishing pad is circular.

5. The apparatus as set forth in claim 1, wherein said polishing pad is elliptic.

6. The apparatus as set forth in claim 5, wherein a short diameter of said polishing pad is smaller than a radius of said substrate.

7. The apparatus as set forth in claim 1, wherein said polishing pad is non-circular.

8. The apparatus as set forth in claim 7, wherein said polishing pad is a polishing pad obtained by partly cutting out at least one region of a periphery of a circular polishing pad.

9. The apparatus as set forth in claim 1, wherein said control circuit drives said polishing platen and said polishing head to rotate in opposite directions to each other.

10. The apparatus as set forth in claim 1, wherein said polishing head comprises a pipe for supplying polishing liquid aid substrate.

11. A method for polishing a substrate in a polishing apparatus including: a polishing platen for mounting said substrate; a polishing head; a polishing pad adhered to a bottom face of said polishing head; and a rocking section, connected to said polishing head, for rocking said polishing head with respect to said polishing platen, comprising the steps of:

calculating a contact area of said polishing pad to said substrate;

calculating a load of said polishing pad by multiplying the contact area of said polishing pad to said substrate a constant polishing pressure value; and controlling a load of said polishing pad in accordance with the calculated load of said polishing pad.

12. The method as set forth in claim 11, wherein a diameter of said polishing pad is approximately half of a diameter of said substrate.

13. The method as set forth in claim 11, wherein said polishing pad is circular.

14. The method as set forth in claim 11, wherein said polishing pad is elliptic.

15. The method as set forth in claim 14, wherein said contact area calculating step calculates an area of said polishing pad by $$\pi(a+b)^2/4$$

where "a" is a long diameter of said polishing pad; and

"b" is a short diameter of said polishing pad.

16. The method as set forth in claim 14, wherein a short diameter of said polishing pad is smaller than a radius of said substrate.

17. The method as set forth in claim 11, wherein said polishing pad is non-circular.

18. The method as set forth in claim 17, wherein said polishing pad is a polishing pad obtained by partly cutting out at least one region of a periphery of a circular polishing pad.

19. The method as set forth in claim 17, wherein said contact area calculating step calculates an area of said polishing pad by $$\pi r^2$$

where r is an equivalent radius of a circular polishing pad having the same area as said polishing pad.

20. The method as set forth in claim 11, further comprising a step of driving said polishing platen and said polishing head to rotate in opposite directions to each other.

21. The method as set forth in claim 20, wherein a rotational speed of said polishing head is twice a rotational speed of said substrate.

* * * * *

UNITED STATES PATENT AND TRADEMARK OFFICE

CERTIFICATE OF CORRECTION

PATENT NO. : 6,270,392 B1
DATED : August 7, 2001
INVENTOR(S) : Y. Hayashi et al.

It is certified that error appears in the above-identified patent and that said Letters Patent is hereby corrected as shown below:

Title page,
Item [73], Assignees, "Niken Corporartion" should read -- Nikon Corporation --

Column 3,
Line 3, "load($t_0$)" should read -- load L($t_0$) --

Column 8,
Line 66, "tile" should read -- the --

Column 12,
Line 53, "100 Å/min." should read -- 1,100 Å/min. --

Column 14,
Line 12, "adsorbed" should read -- absorbed --

Signed and Sealed this

Twenty-eighth Day of May, 2002

*Attest:*

*Attesting Officer*

JAMES E. ROGAN
*Director of the United States Patent and Trademark Office*

UNITED STATES PATENT AND TRADEMARK OFFICE

CERTIFICATE OF CORRECTION

PATENT NO. : 6,270,392 B1
DATED : August 7, 2001
INVENTOR(S) : Y. Hayashi et al.

It is certified that error appears in the above-identified patent and that said Letters Patent is hereby corrected as shown below:

Column 13,
Line 59, "stations," should read -- stations --

Signed and Sealed this

Second Day of March, 2004

JON W. DUDAS
*Acting Director of the United States Patent and Trademark Office*